US008134275B2

(12) United States Patent
Kavetsky et al.

(10) Patent No.: US 8,134,275 B2
(45) Date of Patent: Mar. 13, 2012

(54) HIGH EFFICIENCY 4-π NEGATRON β-3 PARTICLE EMISSION SOURCE FABRICATION AND ITS USE AS AN ELECTRODE IN A SELF-CHARGED HIGH-VOLTAGE CAPACITOR

(75) Inventors: Alexander Kavetsky, Champaign, IL (US); Galena Yakubova, Champaign, IL (US); Shahid Yousaf, Charleston, IL (US); Gabriel Walter, Urbana, IL (US); Doris Chan, Champaign, IL (US); Maxim Sychov, St. Petersburg (RU); Qian Lin, Charleston, IL (US); Ken Bower, Charleston, IL (US)

(73) Assignee: Trace Photonics, Inc., Charleston, IL (US)

( * ) Notice: Subject to any disclaimer, the term of this patent is extended or adjusted under 35 U.S.C. 154(b) by 908 days.

(21) Appl. No.: 12/275,974

(22) Filed: Nov. 21, 2008

(65) Prior Publication Data

US 2012/0038243 A1 Feb. 16, 2012

(51) Int. Cl.
*G21H 1/00* (2006.01)

(52) U.S. Cl. ..... 310/303; 136/253; 361/301.1; 438/19; 427/77; 322/2 R

(58) Field of Classification Search ..... 310/303; 136/253, 291–293; 361/301.1–330; 438/19; 427/77; 322/2 R; 257/428–429
See application file for complete search history.

(56) References Cited

U.S. PATENT DOCUMENTS 5,008,579 A * 4/1991 Conley et al. ..... 310/303
5,124,610 A * 6/1992 Conley et al. ..... 310/303
5,443,657 A * 8/1995 Rivenburg et al. ..... 136/253
5,510,665 A * 4/1996 Conley ..... 310/303
5,605,171 A * 2/1997 Tam ..... 136/253
5,616,928 A * 4/1997 Russell et al. ..... 250/515.1
5,642,014 A * 6/1997 Hillenius ..... 310/303
5,721,462 A * 2/1998 Shanks ..... 310/303
5,800,857 A * 9/1998 Ahmad et al. ..... 427/80
5,854,499 A * 12/1998 Nishioka ..... 257/295
5,867,363 A * 2/1999 Tsai et al. ..... 361/502
5,970,337 A * 10/1999 Nishioka ..... 438/240
5,980,977 A * 11/1999 Deng et al. ..... 427/79
6,150,604 A * 11/2000 Freundlich et al. ..... 136/253
6,297,527 B1 * 10/2001 Agarwal et al. ..... 257/306
6,326,541 B1 * 12/2001 Goheen ..... 136/253
6,407,483 B1 * 6/2002 Nunuparov et al. ..... 310/339
6,514,296 B1 * 2/2003 Tsai et al. ..... 29/25.03
6,720,096 B1 * 4/2004 Matsushita et al. ..... 428/701
6,753,469 B1 * 6/2004 Kolawa et al. ..... 136/253
7,482,533 B2 * 1/2009 Putnam ..... 136/253
7,491,881 B2 * 2/2009 Putnam ..... 136/253
7,491,882 B2 * 2/2009 Putnam ..... 136/253
2004/0121451 A1 * 6/2004 Moritz et al. ..... 435/287.2
2004/0173837 A1 * 9/2004 Agarwal et al. ..... 257/306
2004/0258927 A1 * 12/2004 Conzone et al. ..... 428/429

* cited by examiner

*Primary Examiner* — Quyen Leung
*Assistant Examiner* — Alex W Mok
(74) *Attorney, Agent, or Firm* — Thompson Coburn LLP

(57) ABSTRACT

The present invention is directed to an encapsulated $\beta^-$ particle emitter that comprises a sol-gel derived core that comprises a $\beta^-$-emitting radioisotope and an encapsulant enclosing the core through which at least some of the $\beta^-$ emissions from the $\beta^-$-emitting radioisotope pass, wherein the encapsulant comprises a substrate and a cover and at least a portion of the encapsulant is electrically conductive, and a method for making the same. Additionally, the present invention is directed to a capacitor comprising such an encapsulated $\beta^-$ particle emitter and a method of performing work with such a capacitor.

49 Claims, 30 Drawing Sheets

% Uranyl nitrate in sol: (a) 90%, (b) 78%, (c) 48%, (d) 31%, (e) 0%

(a) 80% uranyl nitrate-titania sol; (b) uranyl nitrate solution in water

20% salt loading (...), 5% salt loading(---), and 18% salt loading in acidic sol (▨)

a b a b

HIGH EFFICIENCY 4-π NEGATRON β-3 PARTICLE EMISSION SOURCE FABRICATION AND ITS USE AS AN ELECTRODE IN A SELF-CHARGED HIGH-VOLTAGE CAPACITOR

STATEMENT REGARDING FEDERALLY SPONSORED RESEARCH OR DEVELOPMENT

This invention was made with Government support under contract W15QKN-04-C-1123 awarded by the U.S. Army, Picatinny Arsenal. The Government has certain rights in this invention.

BACKGROUND OF THE INVENTION

There are several ways to convert radioactive decay energy into electricity. One of them is the simple accumulation of decay particle charge across the changing potential of a capacitor. The direct charge capacitor can be charged by either alpha or beta particles from nuclear decay sources. Although capacitors with alpha emitters can produce higher voltages, suppression of secondary electrons from the alpha sources requires an external electrical power supply. Anno, "A Direct-Energy Conversion Device Using Alpha Particles," *Nuclear News,* 6, 3 (1962). This shortcoming of a conventional direct charge alpha capacitors has resulted in them requiring as much energy to operate as they can produce, which has limited their practical use despite the fact that they can provide conversion up to the megavolt range.

On the other hand, nuclear decay with negatron ($\beta^-$) beta emission is of special interest and involves the conversion of a neutron to a proton, electron, and antineutrino, the last two of which are ejected from the nucleus. Therefore, there is conservation of charge and the kinetic energy of the electron can propel it to the collector plate while the newly created proton is left in the emitter plate. The direct charge beta capacitor is unique in comparison to other electric generators using radioactive decay energy in that the beta capacitor produces relatively high working voltage (kilovolts) and relatively low current and this energy conversion from electron kinetic energy to electric charge can be performed relatively efficiently. But because of the relatively high voltage and relatively low current, there has been little, if any, use of such capacitors in commercial electronic devices. Nevertheless, efforts to develop such capacitors, in particular pulsed capacitors with high energy density, continue because capacitor energy is a function of the square of its operating voltage.

Despite significant work on $\beta^-$ direct charge capacitors over the years, most if not all of the heretofore known capacitors remain relatively inefficient. Specifically, if efficiency of a direct charge capacitor is quantified as the ratio of useful electrical power to the thermal power of the isotopes used in capacitor, the best known experimental direct charge capacitors have had efficiencies of less than about two percent. See, Lazarenko et al., "Desk-size Nuclear Sources of the Electricity Energy," Energoatomizdat, Russia (1992). Further, for solid dielectric direct charge beta capacitors, only the penetrating radiation of Sr-90/Y-90 has shown measurable results, and that at an efficiency of less than about one percent. Coleman, "Radioisotopic High Potential Low-Current Sources," Nucleonics, December, (1953).

In view of the foregoing, a need still exists for a direct charge beta capacitor with improved efficiency.

SUMMARY OF THE INVENTION

The present invention is directed to an encapsulated $\beta^-$ particle emitter that comprises a sol-gel derived core that comprises a $\beta^-$-emitting radioisotope and an encapsulant enclosing the core through which at least some of the $\beta^-$ emissions from the $\beta^-$-emitting radioisotope pass, wherein the encapsulant comprises a substrate and a cover and at least a portion of the encapsulant is electrically conductive.

The present invention is also directed to a method for making an encapsulated $\beta^-$ particle emitter. The method comprising depositing a $\beta^-$-emitting radioisotope-containing sol-gel on a surface of a substrate, curing the deposited $\beta^-$-emitting radioisotope-containing sol-gel to form a solid radioactive oxide coating comprising the $\beta^-$-emitting radioisotope and an oxide, and placing a cover, at least a portion of which is an electrically conductive sheet, on the deposited $\beta^-$-emitting radioisotope-containing sol-gel so that cover in combination with the substrate encapsulate the cured deposited $\beta^-$-emitting radioisotope-containing sol-gel.

Additionally, the present invention is directed to a directly charged beta (negatron) nuclear decay capacitor comprising an encapsulated $\beta^-$ particle emitter, an electrically conductive collector for collecting $\beta^-$ particles from the encapsulated $\beta^-$ particle emitter, and a dielectric between the encapsulated $\beta^-$ particle emitter and the electrically conductive collector, wherein the encapsulated $\beta^-$ particle emitter comprises a sol-gel derived core that comprises a $\beta^-$-emitting radioisotope and an encapsulant enclosing the core through which at least some of the $\beta^-$ emissions from the $\beta^-$-emitting radioisotope pass, wherein the encapsulant comprises a substrate and a cover and at least a portion of the encapsulant is electrically conductive.

The present invention is further directed to a method of performing work, the method comprising delivering the electrical energy of a directly charged beta (negatron) nuclear decay capacitor through a circuit. The directly charged beta (negatron) nuclear decay capacitor comprises an encapsulated $\beta^-$ particle emitter, an electrically conductive collector for collecting $\beta^-$ particles from the encapsulated $\beta^-$ particle emitter, and a dielectric between the encapsulated $\beta^-$ particle emitter and the electrically conductive collector, wherein the encapsulated $\beta^-$ particle emitter comprises a sol-gel derived core that comprises a $\beta^-$-emitting radioisotope and an encapsulant enclosing the core through which at least some of the $\beta^-$ emissions from the $\beta^-$-emitting radioisotope pass, wherein the encapsulant comprises a substrate and a cover and at least a portion of the encapsulant is electrically conductive.

Still further, the present invention is directed to a directly charged beta (negatron) nuclear decay capacitor comprising a $\beta^-$ particle emitter, an electrically conductive collector for collecting $\beta^-$ particles from the $\beta^-$ particle emitter, and a dielectric between the encapsulated $\beta^-$ particle emitter and the electrically conductive collector, wherein at least the portion of the collector for which $\beta^-$ particles from the emitter will be incident is a metal and is contact with a volume of one or more radiation-resistant polymers that suppress the emission of secondary electrons from said metallic portion of the collector.

DETAILED DESCRIPTION OF THE INVENTION

I. Beta Capacitor

A. Configuration

Figure 1:
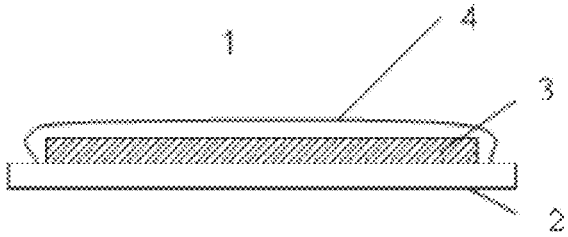
FIG. 1 is a schematic drawing of the nuclear negatron ($\beta^-$) source, either as $2\pi$ or $4\pi$, depending on the surface density of the substrate.
Figure 2A:
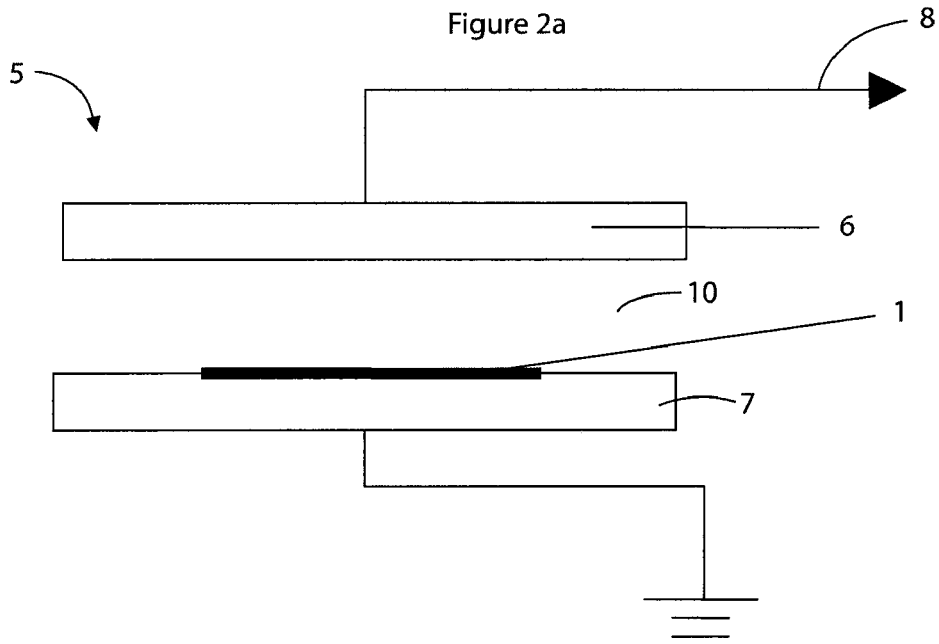
FIGS. 2*a* and 2*b* are schematic drawings of a nuclear direct charge cell of a cylindrical geometry.
Figure 2B:
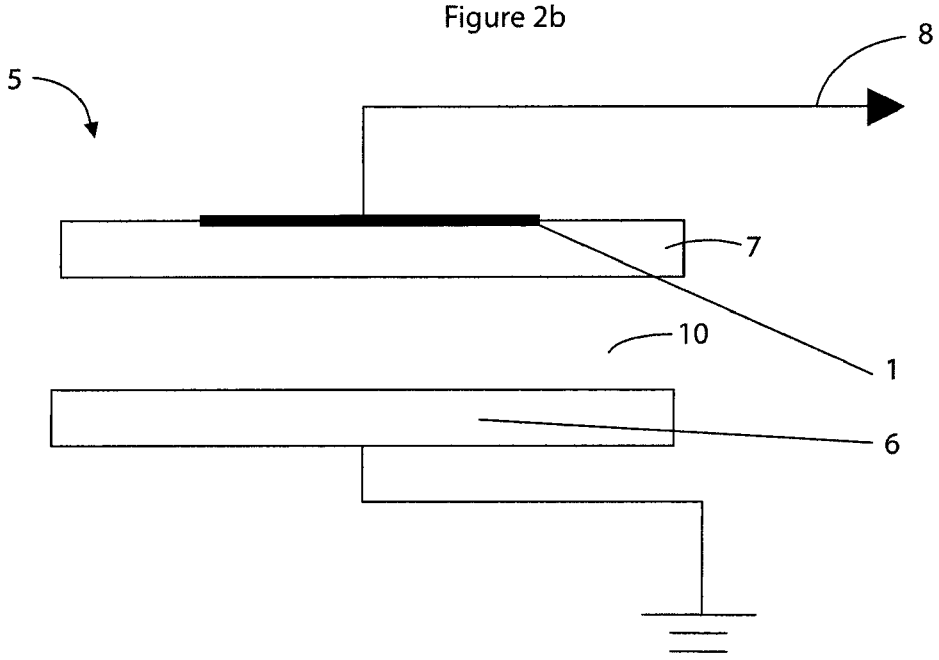
Figure 3:
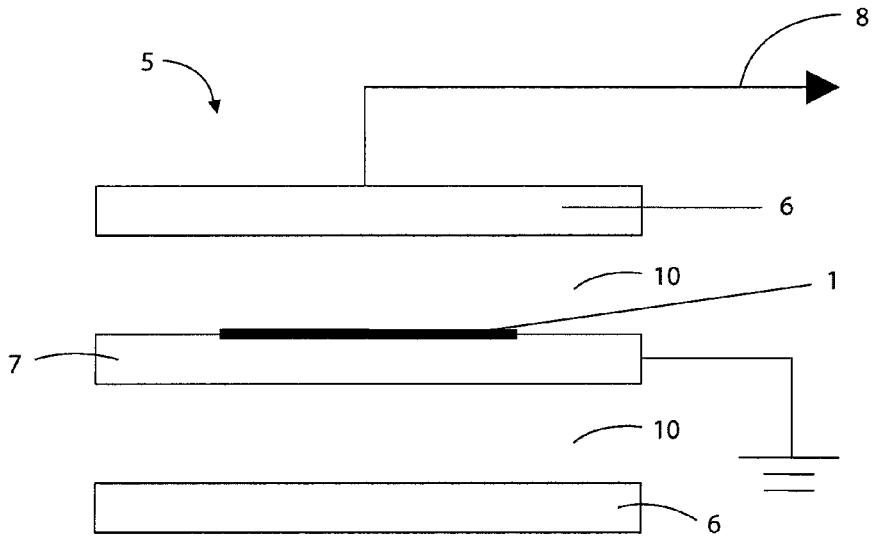
FIG. 3 is a schematic drawing of a negatron direct charge capacitor with parallel plates and $2\pi$ source.
Figure 4:
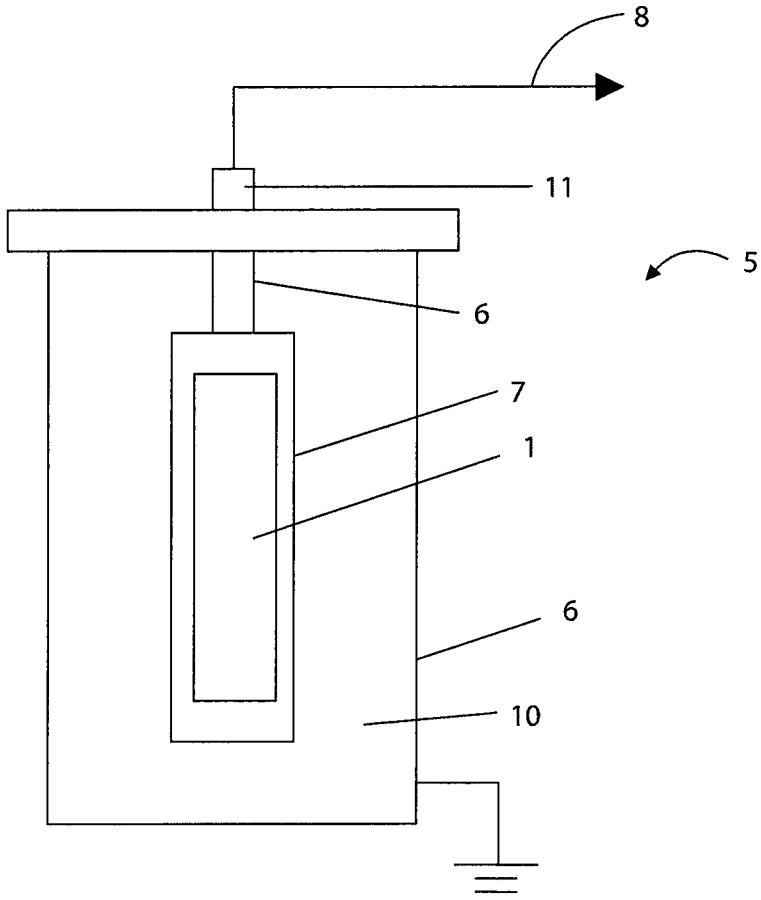
FIG. 4 is a schematic drawing of a nuclear direct charge cell of parallel plate geometry and $4\pi$ source.
Figure 5:
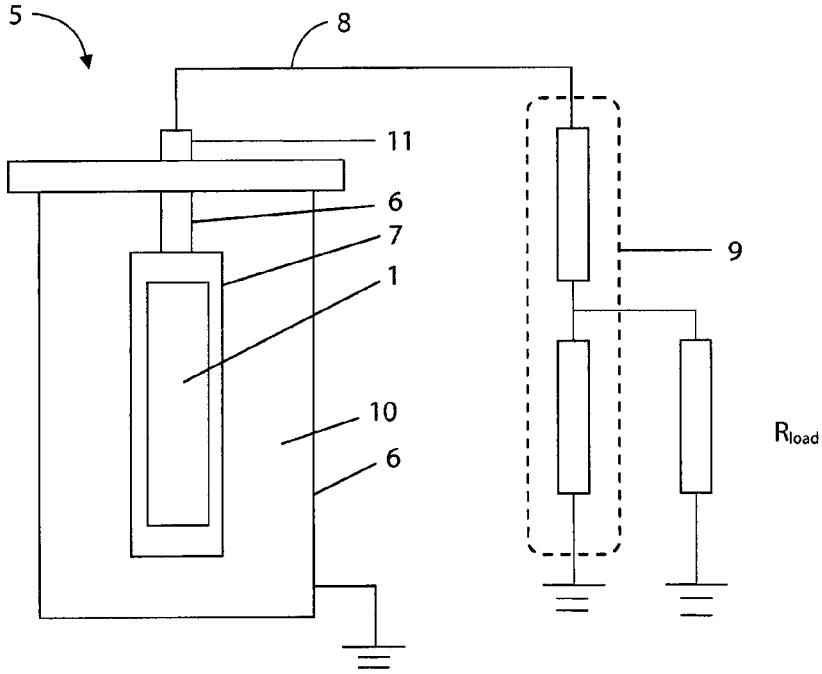
FIG. 5 is a schematic drawing of a negatron charged capacitor with output voltage divider.

The heart of a direct charge beta capacitor is the radioactive source. FIG. 1 depicts a nuclear negatron ($\beta^-$) source radioactive source 1, which may be either 2π or 4π, depending on the surface density of the substrate. The radioactive source comprises a radioactive isotope-containing cured sol-gel derived glass 3 encapsulated by a electrically conductive substrate 2 and protective cover 4, which may be electrically conductive, semiconductive, or insulating. Referring to FIG. 2*a*, for example, a 2π radioactive source 1 is configured in a beta charge capacitor 5 by being placed on or in a conductive support 7 (e.g., metal foil), which is grounded, facing a collector 6 (e.g., metal foil) on which the negative electrostatic charge is accumulated, separated by a dielectric 10, which may be a vacuum or other appropriate insulting material (liquid or solid). FIG. 2*b* is similar to that of FIG. 3*a*, the collector is grounded. Alternative configurations for beta charge capacitor are also set forth in FIGS. 2-5. FIG. 3 is similar to the configurations set forth in FIG. 2*a* and *b* but the radioactive source 1 is a 4π source on conductive substrate 7 and two collectors 6 are facing it. In FIG. 4, the nuclear direct charge cell 5 has a cylindrical geometry. Specifically, the 4π radioactive source 1, which is in electrical contact with high voltage electrode 11 and lead 8 is surrounded by a generally cylindrical collector 6, which is grounded. In FIG. 5, the nuclear direct charge cell 5 depicted is shown with high voltage lead 8 being in electrical connections with a voltage divider 9, which is in electrical connection with a load.

B. Charging a Beta Capacitor

As described above, in the simplest case, a beta capacitor comprises a radioactive source on or in a conductive foil, facing a metal foil on which the negative electrostatic charge is accumulated, separated by a dielectric. Not all of the beta decay electrons get out of the source and of those that do, not all reach the collector. A portion of the emissions directed toward the collector from the radioactive source are accumulated thereon and the remaining are accounted for through leakage resistance, $R_{leak}$. At each time interval from t to t+dt, the charge emitted from the radioactive source toward the collector $dQ_{in}=I_{Ch}\cdot dt$. $I_{Ch}$ is the charging current adding charge to the capacitor plate, $dQ_C$, and is also subject to leakage, $-dQ_R$. The charging current, which may be measured between collector and ground, is also referred to as the short circuit current, $I_{sc}$. For a cell with capacitance C, and the voltage accumulated with time, U(t);

$$dQ_{in} = dQ_C + dQ_R,\ dQ_{in} = I_{Ch}\cdot dt,\ dQC = C\cdot dU(t); \tag{1}$$

$$dQ_R = \frac{U(t)}{R_{leak}}dt;\ \text{and} \tag{2}$$

$$I_{Ch}\cdot dt = C\cdot dU(t) + \frac{U(t)}{R_{leak}}\cdot dt \text{ or } \frac{dU(t)}{dt} + \frac{U(t)}{R_{leak}\cdot C} = \frac{I_{Ch}}{C}. \tag{3}$$

Early in the charge accumulation cycle, when $I_{Ch}$ is not impeded by the increasing collector voltage, a solution to Equation 3 is:

$$U(t) = I_{Ch} \cdot R_{leak}\left[1 - \exp\left(-\frac{t}{R_{leak} \cdot C}\right)\right]. \tag{4}$$

When the time $t \gg R_{leak} \cdot C$, accumulated voltage approaches saturation $U_{sat}$ and when the leakage resistance is the only resistance of the cell, $R_c$, then $U_{sat}$ is the open circuit voltage, $U_{oc}$:, such that:

$$U_{oc} = I_{sc} \cdot R_c. \tag{5}$$

But when $t \gg R_{leak} \cdot C$, U(t) is directly proportional to t such that:

$$U(t) = \frac{I_{sc} \cdot t}{C}. \tag{6}$$

C. Efficiency of the Beta Capacitor

The saturated beta capacitor voltage can be calculated using Equation 5. If the beta capacitor is connected in parallel to an external load with resistance r, then the leakage resistance is:

$$R_{leak} = \frac{R_c \cdot r}{R_c + r}, \tag{7}$$

where $R_c$ is the internal resistance of the beta capacitor. $U_{sat}$ can be substituted to give:

$$U_{sat} = I_{sc} \cdot \frac{R_c \cdot r}{R_c + r}, \tag{8}$$

The current $I_l$, which will go through external load with resistance r then is:

$$I_l = \frac{U_{sat}}{r} = \frac{I_{sc}}{r} \cdot \frac{R_c \cdot r}{R_c + r} = \frac{I_{sc} \cdot R_c}{R_c + r}. \tag{9}$$

The electrical power on load $P_{el}$ is:

$$P_{el} = U_{sat} \cdot I_l = I_{sc} \cdot \frac{R_c \cdot r}{R_c + r} \cdot \frac{R_c}{R_c + r} = \left(\frac{I_{sc} \cdot R_c}{R_c + r}\right)^2 \cdot r. \tag{10}$$

The dependence of $P_{el}$ on r has a maximum for which the derivative equals zero, when $r = R_c$, which results in $$\frac{R_c \cdot r}{(R_c + r)^2} = 0.25.$$

So, the optimal value of useful power $P_{l,max}$ is at $r = R_c$, and can be estimated as:

$$P_{el,max} = 0.25 \cdot I_{sc}^2 \cdot R_c = 0.25 \cdot U_{oc} \cdot I_{sc}. \tag{11}$$

The power of radioactive decay, $P_{RD}$, available for conversion to electricity can be estimated as $$P_{RD} = A \cdot \in_{av}, \tag{12}$$

where A is the radioactive material activity in Becquerel and $\in_{av}$ is the average energy of radioactive particles emitted in Joule.

The efficiency of the beta capacitor, ξ, when the charging current does not decrease with voltage on the collector as a percent of total thermal energy is:

$$\xi = \frac{P_{el,\max}}{P_{RD}} \cdot 100 = \frac{0.25 \cdot U_{oc} \cdot I_{sc}}{A \cdot \varepsilon_{av}} \cdot 100. \tag{13}$$

With activity in Curies, $\in_{av}$ in kilo electron volts, $I_{sc}$ in nanoamperes, and $U_{oc}$ in kilovolts, Equation 13 is:

$$\xi = 4.22 \cdot \frac{U_{oc}(\text{kV}) \cdot I_{sc}(\text{nA})}{A(\text{Ci}) \cdot \varepsilon_{av}(\text{keV})}. \tag{14}$$

As is apparent from Equation 14, efficiency is highest at the highest possible saturation voltage and charging current. The efficiency of direct charge ($\beta^-$) nuclear decay energy conversion to electricity calculated by Equation 14 and other parameters for converters described in the literature are shown in Table A, below. As shown in Table A, the efficiency of most systems has not been more than 2%. In contrast, as will be shown in greater detail below, utilizing one or more aspects of the present invention has resulted in direct charge ($\beta^-$) nuclear decay energy conversion to electricity systems capable of significantly higher efficiencies (e.g., about 10% and higher).

TABLE A

| | Radioactive source | | | | Electrical parameters of cell | | | |
|---|---|---|---|---|---|---|---|---|
| | | | A | | | | | |
| Type of Direct Charge Cell | Isotope | $\epsilon_{av}$ (keV) | Bq | Ci | $U_{oc}$ (kV) | $I_{sc}$ (nA) | $P_{el}$ (uW) | Eff. (%) |
| Linder[1] | Sr-Y-90 | 589 | $9.3 \cdot 10^9$ | 0.25 | 365 | 1 | 91 | 10.5 |
| Radiation Research Corporation[2] | Tritium | 5.7 | $7.4 \cdot 10^9$ | 0.2 | 0.4 | 0.05 | 0.01 | 0.07 |
| Rappaport[3] | Sr-Y-90 | 589 | $7.4 \cdot 10^7$ | 0.002 | 3.7 | 0.01 | 0.01 | 0.13 |
| | Sr-Y-90 | 589 | $2.0 \cdot 10^9$ | 0.054 | 6.6 | 0.25 | 0.41 | 0.22 |
| Radiation Research Corporation[4] | Sr-Y-90 | 589 | $3.7 \cdot 10^8$ | 0.01 | 7 | 0.04 | 0.07 | 0.20 |
| Sandia Corporation[5] | Kr-85 | 251 | $3.0 \cdot 10^{10}$ | 0.8 | 20 | 1.2 | 6.00 | 0.50 |
| Gorlovoy[6] | Sr-Y-90 | 589 | $3.7 \cdot 10^8$ | 0.01 | 0.3 | 0.1 | 0.01 | 0.02 |
| Majak[7] BP-1 | Pm-147 | 62 | $1.7 \cdot 10^{12}$ | 46 | 21 | 52 | 273 | 1.62 |
| BP-2 | Pm-147 | 62 | $2.6 \cdot 10^{12}$ | 70 | 23 | 20 | 115 | 0.45 |
| BP-3 | Pm-147 | 62 | $3.7 \cdot 10^{12}$ | 100 | 25 | 90 | 563 | 1.53 |

TABLE A-continued

| | Radioactive source | | | | Electrical parameters of cell | | | |
|---|---|---|---|---|---|---|---|---|
| | | | A | | | | | |
| Type of Direct Charge Cell | Isotope | $\epsilon_{av}$ (keV) | Bq | Ci | $U_{oc}$ (kV) | $I_{sc}$ (nA) | $P_{el}$ (uW) | Eff. (%) |
| BP-4 | Pm-147 | 62 | $3.5 \cdot 10^{12}$ | 94 | 30 | 72 | 540 | 1.56 |
| BP-5 | Pm-147 | 62 | $4.1 \cdot 10^{12}$ | 110 | 23 | 55 | 316 | 0.78 |
| BP-6 | Pm-147 | 62 | $4.3 \cdot 10^{12}$ | 115 | 30 | 51 | 383 | 0.91 |
| BPM-1 | Pm-147 | 62 | $3.0 \cdot 10^{11}$ | 8 | 21 | 10 | 53 | 1.79 |
| BPM-2 | Pm-147 | 62 | $6.3 \cdot 10^{11}$ | 17 | 25 | 15 | 94 | 1.50 |
| BPM-3 | Pm-147 | 62 | $9.3 \cdot 10^{11}$ | 25 | 28 | 18 | 126 | 1.37 |
| BPM-4 | Pm-147 | 62 | $7.4 \cdot 10^{11}$ | 20 | 19 | 16 | 76 | 1.03 |
| BPM-5 | Pm-147 | 62 | $1.2 \cdot 10^{12}$ | 31 | 42 | 24 | 252 | 2.21 |
| BPM-6 | Pm-147 | 62 | $1.3 \cdot 10^{12}$ | 35 | 45 | 27 | 304 | 2.36 |
| BPM-7 | Pm-147 | 62 | $2.6 \cdot 10^{12}$ | 70 | 30 | 63 | 473 | 1.84 |
| BPM-8 | Pm-147 | 62 | $1.2 \cdot 10^{12}$ | 31 | 35 | 23 | 201 | 1.77 |
| J. Braun[8] | Tritium | 5.7 | $1.8 \cdot 10^{11}$ | 4.8 | 0.69 | 2.8 | 0.48 | 0.29 |

[1]Linder et al., "Use of Radioactive Material for the Generation of High Voltage," J. Appl. Phys., 23, 11, 1213 (1952).
[2]Coleman, "Nuclear Energy Sources," Proc., 12th Annual Battery Research and Development Conference, 108, Power Sources Division, Ft. Monmouth, N. J. (May 1958).
[3]Rappaport et al., "Radioactive Charging Effects With Dielectrics," J. Appl. Phys., 24, 9 (1953).
[4]Coleman, "Radioisotope High-Potential Low-Current Sources," Nucleonics, 11, 12, 42 (1953).
[5]Windle, "Microwatt Radioisotope Energy Converters," IEEE Transactions on Aerospace, 2, 2, 646 (1964).
[6]Gorlovoy et al., "Charging Device With Nuclear Battery," Atomic Energy, 4, 382 (1950).
[7]Lazerenko et al., "Desk-size Nuclear Sources of the Electricity Energy," Energoatomizdat, Russia (1992).
[8]Braun et al., "Theory and Performance of a Tritium Battery for the Microwatt Range," Journal of Physics E: Scientific Instruments, 6 (1973).

D. Effect of Radioactive Layer Thickness on Charging Current

A direct charge capacitor may be configured to optimize the charging current per surface area unit of activity. The charging current is proportional to the specific beta flux power on the surface of the sources and surface area of sources. The specific beta flux power on the surface of a source depends on the thickness, specific activity, and density of a radioactive layer. For example, when using titanium titride the maximum specific activity is approximately $4.1.10^{13}$ Bq/g (1100 Ci/g) and because the specific beta flux is increasingly limited by adsorption of tritium beta particles as layer thickness increases, the highest beta flux power $P_{sp,max}$ is approximately 0.8 uW/cm$^2$, at a thickness of approximately 0.7 um, which results in a surface activity of about $1.04 \cdot 10^{10}$ Bq/cm$^2$ (0.28 Ci/cm$^2$) (based on a density of 3.7 g/cm$^3$ for titanium tritide). At layer thicknesses greater than one micron, however, a significant portion of the beta particles tend to be self-absorbed. The optimal charging particle current density can be estimated by $$\frac{P_{sp,max} \cdot q}{\varepsilon_{av}} = 0.14 \text{ nA/cm}^2.$$

Geometrical factors and accumulating high voltage potential on collectors then limit the effective charging particles current.

Calculated specific activities of chemical compounds used as carriers for tritium, nickel-63, promethium-147, and strontium-90 are shown in Table B, below. The calculations assume the practical specific activities of isotopes, giving current densities for tritium of 0.15 nA/cm$^2$, for nickel-63, 0.015 nA/cm$^2$, promethium-147, 0.5 nA/cm$^2$, and strontium-90/yttrium-90, 4 nA/cm$^2$. The device power then is directly scalable with source surface area. Increased specific activities, from freshly prepared isotopes for example, can improve current densities. Freshly prepared promethium-147 can provide current flux 20-50 times larger.

TABLE B

Specific activities of chemical compounds carrier of tritium, nickel-63, promethium-147, and strontium-90

| | Isotope | | | |
|---|---|---|---|---|
| Parameter | Tritium | Nickel-63 | Promethium-147 | Strontium-90 |
| Half-life, years | 12.32 | 100.1 | 2.62 | 28.9 |
| Average energy of beta particles, keV | 5.7 | 17.4 | 62 | 198 (Y-90 930) |
| Chemical compound | Ti $^3H_2$, $Sc^3H_2$ | $^{63}Ni$ | $^{147}Pm_2O_3$ | $^{90}Sr(NO_3)_2$ |
| Specific activity of chemical compound(*), Ci/mg | 1.1 | 0.057 | 0.8 | 0.058 |
| Matrix or binder | Titanium or scandium hydride | Metal nickel | Enamel | Graphite, ceramic |
| Specific activity of radioactive isotope contain layer, Ci/mg | 1.0 | 0.01 | 0.01-0.05 | 0.01 (0.02(**)) |

(*)At one hundred percent contain of radioactive isotope in compound.
(**)Take into account activity of daughter isotope $^{90}Y$ in secular equilibrium with $^{90}Sr$.

Figure 25:
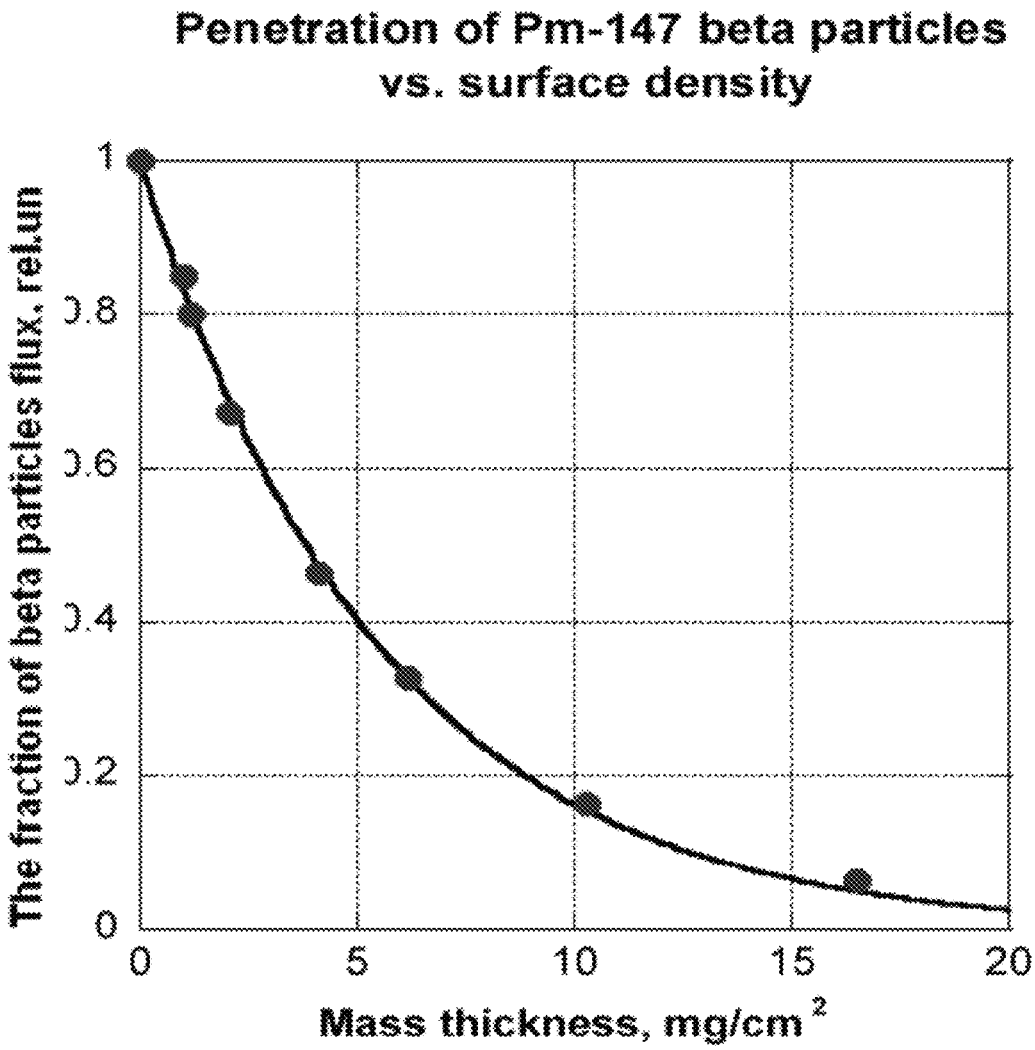
FIG. 25 is a graph showing the dependence of beta particle flux from a promethium-147 radioactive source layer on the mass thickness of said source layer.
Figure 26:
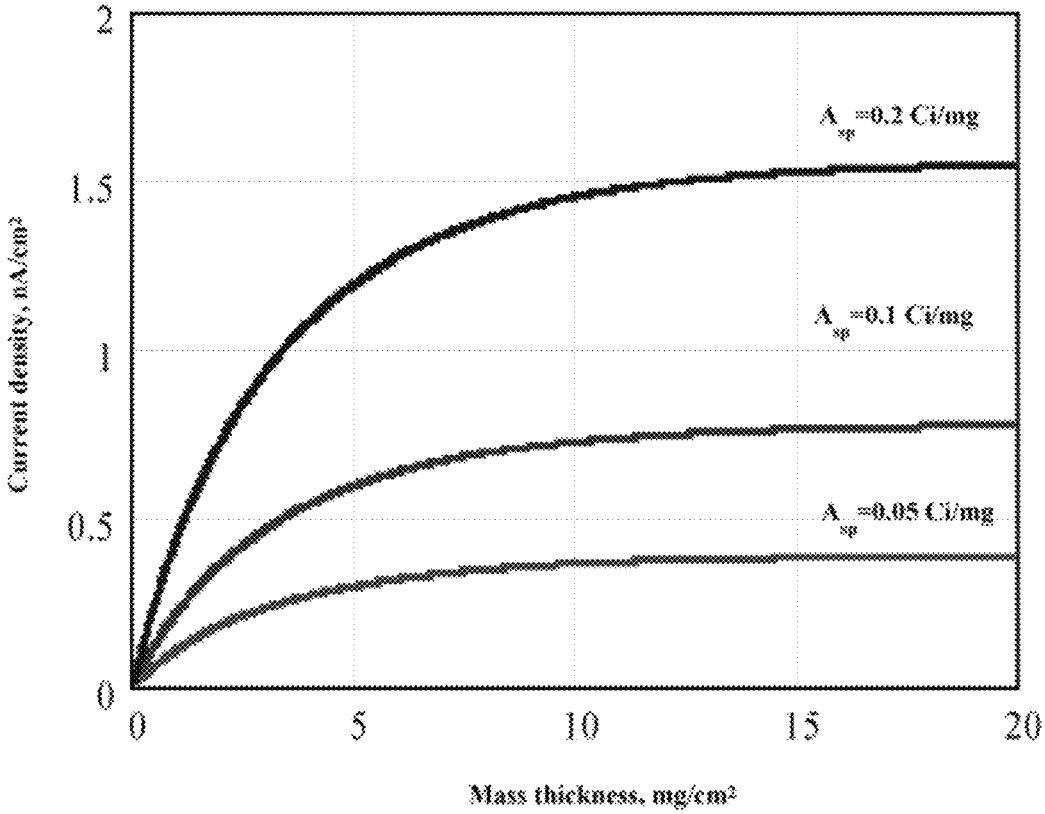
FIG. 26 is a graph showing the dependence of current density of a capacitor comprising one of three different promethium-147 radioactive source layers (each with a different specific activity) on mass thickness of said layer.
Figure 27:
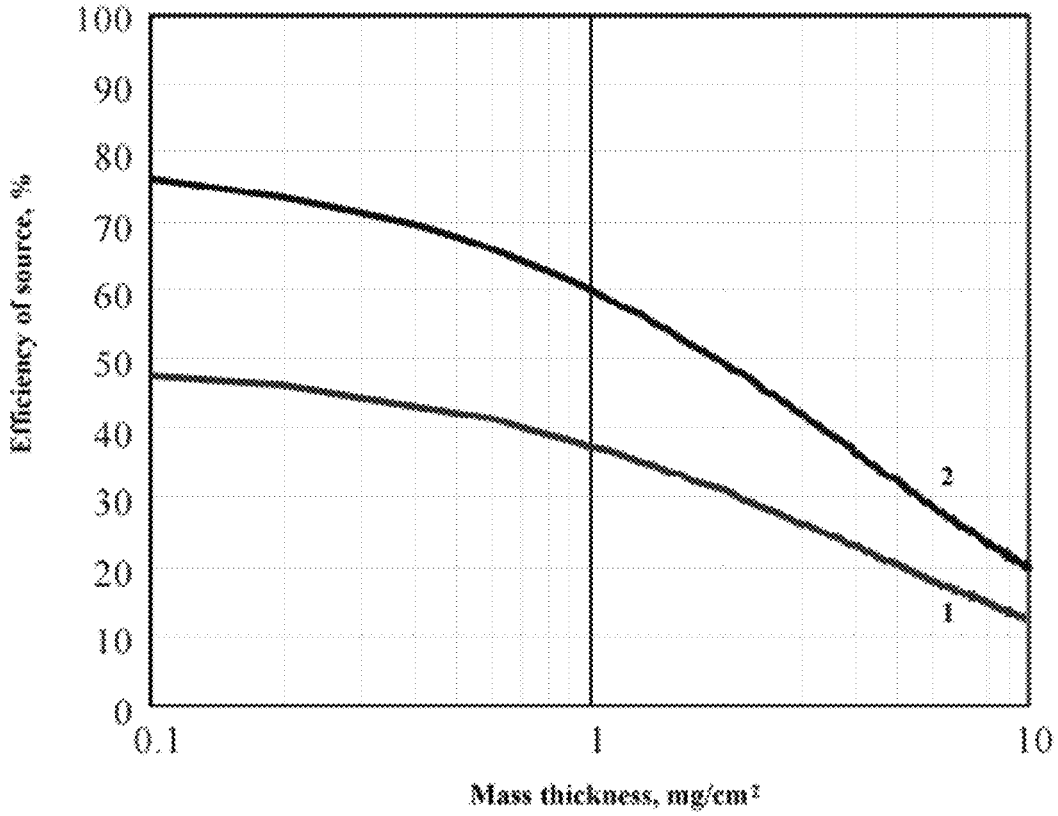
FIG. 27 is a graph showing the dependence of source efficiency on mass thickness for a 2π and a 4π promethium-147 radioactive source layer.
Figure 28:
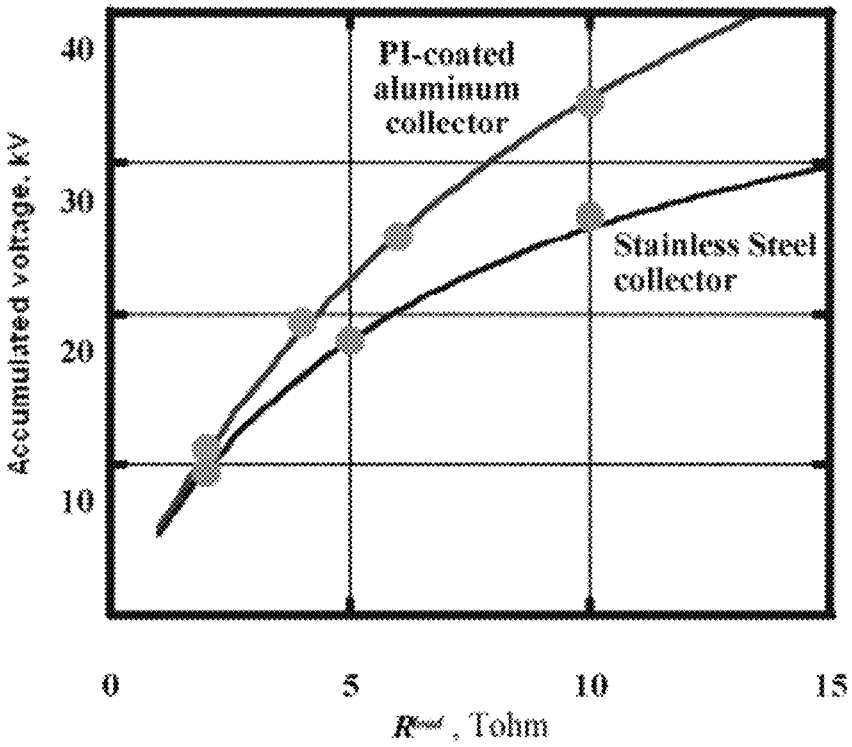
FIG. 28 is a graph showing the difference in accumulated voltage as a function of load resistance for capacitors using an aluminum collector coated with a polyimide secondary electron suppression coating and an uncoated stainless steel collector.
Figure 29:
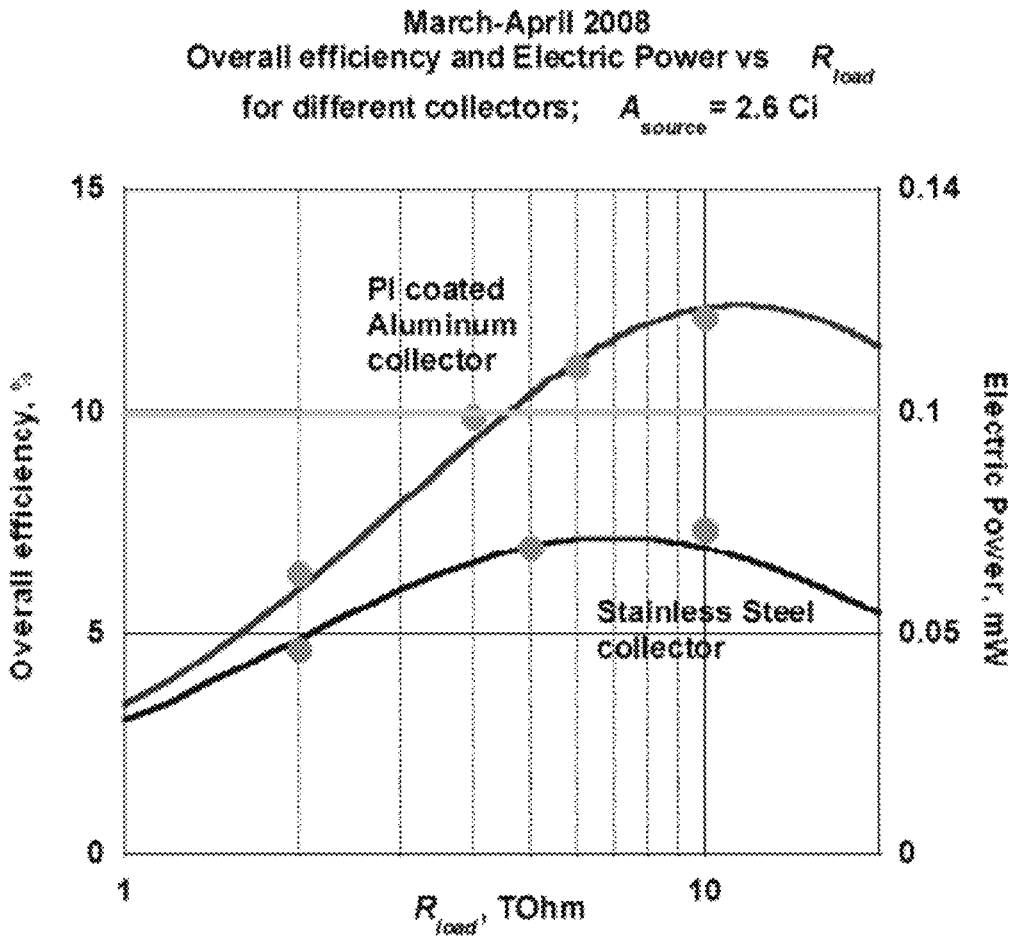
FIG. 29 is a graph showing the difference in overall efficiency and electric power as a function of load resistance for capacitors using an aluminum collector coated with a polyimide secondary electron suppression coating and an uncoated stainless steel collector.
Figure 30:
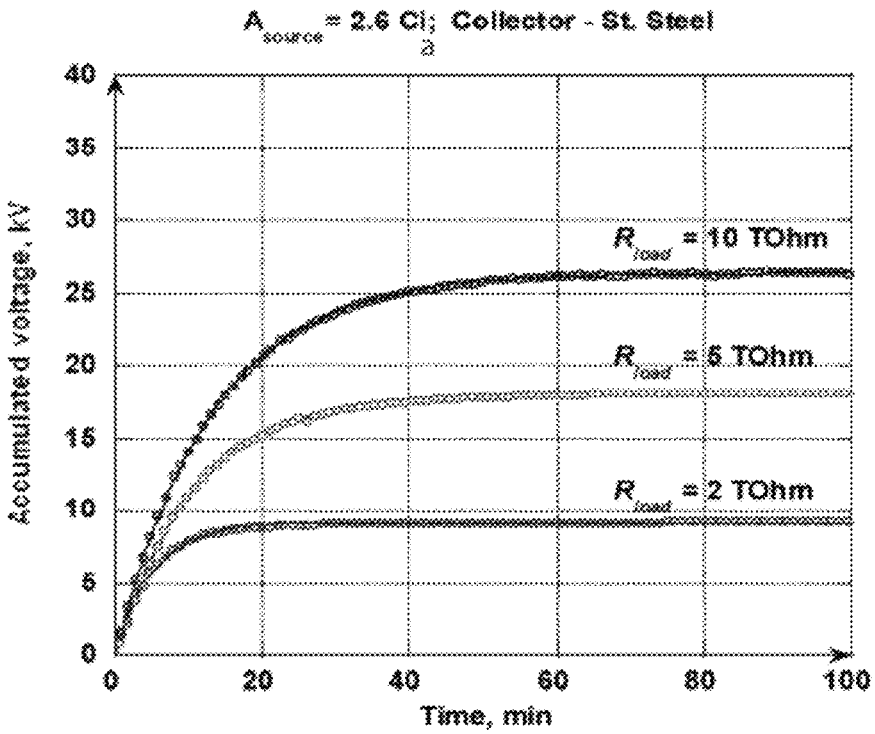
FIG. 30*a* and FIG. 30*b* are graphs showing the accumulated voltage as a function of time at three different load resistances for capacitors using a stainless steel collector and an aluminum collector coated with a polyimide secondary electron suppression coating, respectively.
Figure 30:
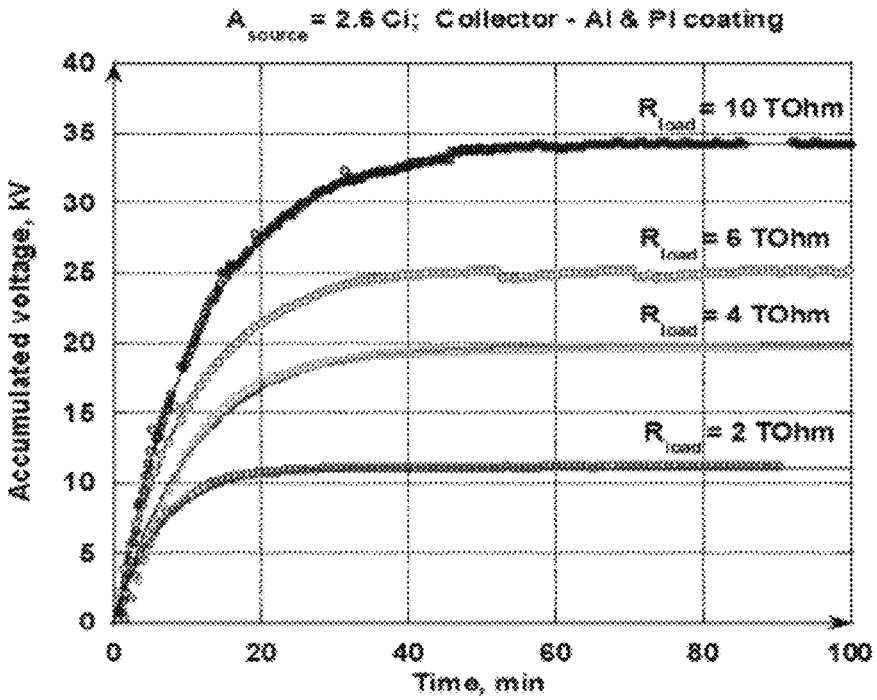

Alternatively, the effect of the radioactive layer may be described in terms of source efficiency, which also depends on the thickness, density, and specific activity of a radioactive layer. Referring to FIG. 25, it can be seen that the beta particles that actually are emitted from the surface of the radioactive layer generally decreases as the thickness and/or mass or density of the layer increases (the fraction is a function of mass thickness, which is equal to the density of the layer multiplied by the thickness). The impact of specific activity and mass thickness of the radioactive layer at one of the major sides of the layer is represented by the following equation $$\frac{dI}{dS}(\text{nA/cm}^2) = \frac{1}{2} 5.92 \cdot A_{Sp} \cdot \int_0^H \int_0^\infty \frac{\exp\left(-\mu_{Pm-147}\sqrt{h^2+r^2}\right) \cdot h \cdot r}{\left(\sqrt{h^2+r^2}\right)^3} dr dh,$$

wherein H represents mass thickness in mg/cm$^2$ and $A_{sp}$ represents specific activity in Ci/mg. Referring to FIG. 26, commercial grade $^{147}Pm_2O_3$ having a specific activity that is between about 0.3 and about 0.5 Ci/mg, when mixed with a sol-gel, can produce a radioactive layer having for example a specific activity of 0.2 Ci/mg, 0.1 Ci/mg, or 0.05 Ci/mg. As is seen in FIG. 26, regardless of the precise specific activity, the current density increases rather significantly as the mass thickness increases from zero but the degree of change tend to decrease substantially as the mass thickness is increased above about 5 mg/cm$^2$. FIG. 27 shows the efficiency of a source, which is the ratio of the number of beta particles ejected from the total surface of a source to all the beta particles produced in the source, as a function of mass thickness. The first curve is for a 2π sources, wherein $$\eta_{layer} = \frac{1}{5.92 \cdot A_{Sp,L} \cdot H} \cdot \frac{dI(H)}{dS} = \frac{1}{2 \cdot H} \cdot \int_0^H \int_0^\infty \frac{\exp\left(-\mu_{Pm-147}\sqrt{h^2+r^2}\right) \cdot h \cdot r}{\left(\sqrt{h^2+r^2}\right)^3} dr dh$$

and the second curve is for a 4π source, wherein $$\eta_{source} = \eta_{layer} \cdot \left[\exp\left(-0.19 \frac{\text{cm}^2}{\text{mg}} \times 0.27 \frac{\text{mg}}{\text{cm}^2}\right) + \exp\left(-0.19 \frac{\text{cm}^2}{\text{mg}} \times 2.16 \frac{\text{mg}}{\text{cm}^2}\right)\right] = 1.61 \cdot \eta_{layer}.$$

Importantly, FIG. 27 shows that efficiencies of at least 50% for a radioactive layer may be achieved by utilizing a 4π radioactive layer having a mass thickness for said layer that is no greater than about 2 mg/cm$^2$.

E. Effect of Capacitor Geometry

Figure 19:
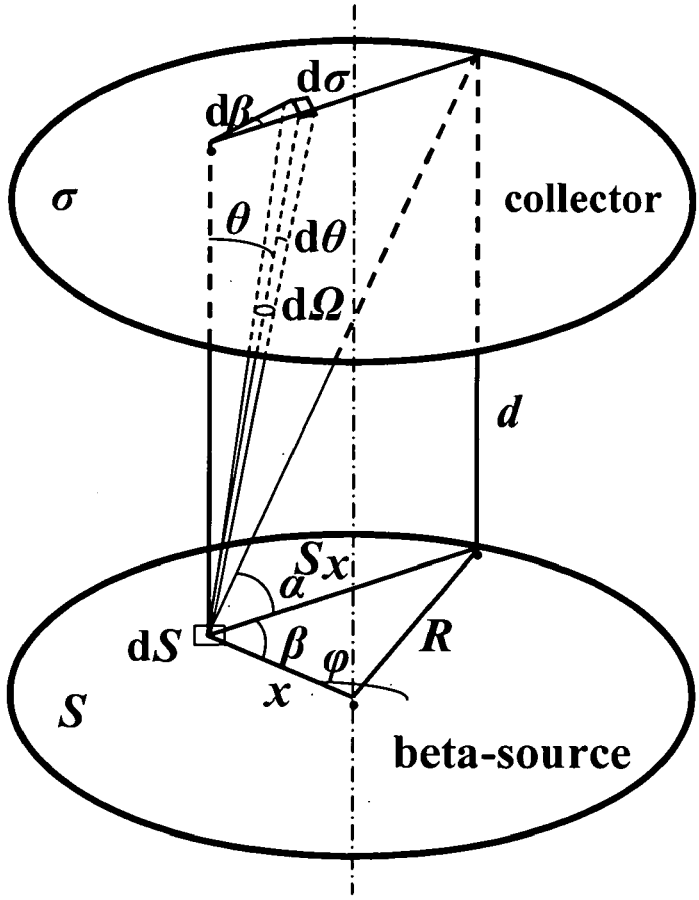
FIG. 19 is depiction of the scheme for the calculation of the fractional beta flux in parallel plate collectors.

Referring to FIG. 19, which depicts a direct charge capacitor with plane-parallel round electrodes having radius R, one electrode is the source of beta particles while the second is their collector. The electrodes are separated by a distance, d, and their centers share an axis perpendicular to the planes of the electrodes. The beta particles flux from each element of the surface in the direction determined by the angles θ and β are represented in the elementary solid angle dΩ as $\phi(\theta,\beta)$ dΩdS. The beta particles flux ϕ from the surface of the source is calculated in the solid angle Ω as $$\Phi = \int_{S_{source}} \int_\Omega \Phi(\theta, \beta)\, d\Omega\, dS. \tag{15}$$

The equation Ω=2π includes all beta particles flux from one side of the source $\phi_{all}$. The fraction η of beta particles flux which reach the collector is $$\eta = \frac{\Phi_{collector}}{\Phi_{all}}. \tag{16}$$

It is assumed that the beta source uniformly ejects beta particles in a solid angle 2π. In this case, $\phi(\theta,\beta)$ is independent of angles ϕ and β, and equals a constant value. Then it is possible to calculate η as $$\eta = \frac{\int_{S_{source}} \int_\Omega \Phi(\theta, \beta)\, d\Omega\, dS}{\int_{S_{source}} \int_{2\pi} \Phi(\theta, \beta)\, d\Omega\, dS} = \frac{\int_{S_{source}} \int_\Omega \cos\theta\, d\Omega\, dS}{\int_{S_{source}} \int_{2\pi} \cos\theta\, d\Omega\, dS}. \tag{17}$$

Taking into account that dΩ=sin θdθdβ, then $$\int_\Omega \cos\theta\, d\Omega = \int_0^{2\pi} \int_0^{\frac{\pi}{2}-\alpha} \cos\theta \cdot \sin\theta\, d\theta\, d\beta = \frac{1}{2} \cdot \int_0^{2\pi} \cos^2\alpha\, d\beta, \text{ and} \tag{18}$$

$$\int_{2\pi} \cos\theta\, d\Omega = \int_0^{2\pi} \int_0^{\frac{\pi}{2}} \cos\theta \cdot \sin\theta\, d\theta\, d\beta = \pi, \tag{19}$$

where angles α and β, as well as Z and dS are as designated in FIG. 19. Angle α depends on angle β and on the distance x between dS and the center of the source. Using polar coordinates with the origin at the center of the source, $$dS = x \cdot dx \cdot d\phi. \tag{20}$$

Substituting Equations 18, 19, and 20 in Equation 17 and integrating, it is derived that $$\eta = \frac{1}{2\pi \cdot \pi R^2} \cdot \int_0^R \int_0^{2\pi} \int_0^{2\pi} \cos^2\alpha \cdot x \cdot d\beta\, d\varphi\, dx = \frac{1}{\pi R^2} \cdot \int_0^R \int_0^{2\pi} \cos^2\alpha \cdot x\, d\beta\, dx. \tag{21}$$

The dependence of distance $S_x$ between dS and the edge of a source from x and angle β can be written as $$S_x = x \cdot \cos\beta + \sqrt{R^2 - x^2 \cdot \sin\beta^2} \text{ and} \tag{22}$$

$$\cos\alpha = \frac{S_x}{\sqrt{S_x^2 + d^2}}. \tag{23}$$

Figure 20:
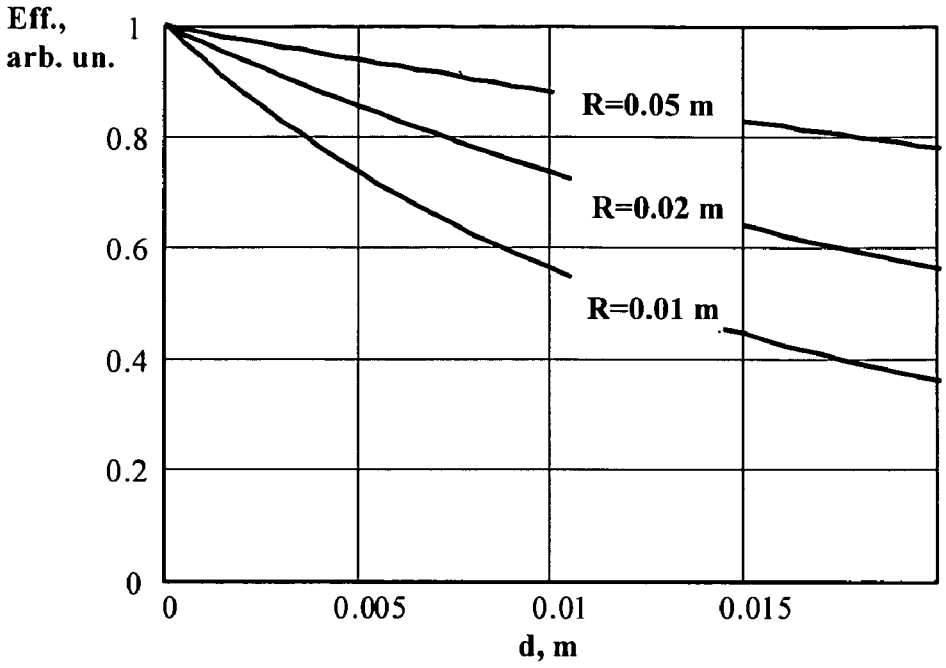
FIG. 20*a* is a graph depicting beta flux reaching collector for different distance between source and collector and various radii of source (and collector).
FIG. 20*b* is a graph depicting beta flux reaching a collector based on different electrode radii and distances between source and collector.
Figure 20:
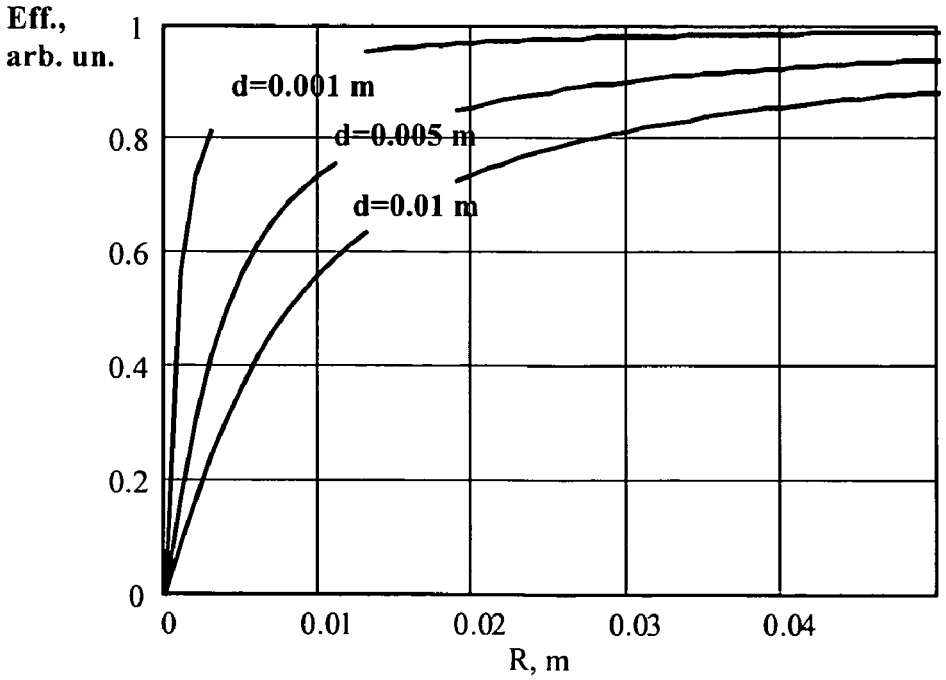

The calculated result for η is displayed in FIGS. 20*a* and 20*b*, which show that the fraction of beta particle flux which reach a collector decreases with increased distance between electrodes and increases with increase of radii of electrodes. For instance, for a source with radius 5 cm and distance to collector of 5 mm, only 90% of the emitted 2π beta particles flux will be reach the collector. This estimate assumes uniform emission of beta particles in a solid angle 2π from each element of surface of the beta source. For a real source, angular distribution of the flux is not uniform and $\phi(\theta,\beta)$ is nearly zero when θ is less than π/2. Therefore, η was estimated conservatively.

F. Effect of Accumulating Voltage on the Charging Current

The voltage from the negative collector charging results in a certain degree of repulsion of incoming beta particles. If the energy of beta particles moving through the growing potential field between the electrodes of a capacitor is less or equal to that field, those beta particles cannot reach the collector. If the particle energy is greater then the product of voltage on a collector and an elementary charge, and the particle is moving under an angle to the source surface, then under action of the electric field it will deviate from its initial rectilinear trajectory. Increasingly fewer beta particles will reach the charging collector compared to the collector at its zero starting voltage.

Any source of beta particles has a specific distribution of energy. In the case of tritium, the beta particle distribution can be represented as:

$$w(\varepsilon_\beta)d\varepsilon_\beta = k\cdot(\varepsilon_{max}-\varepsilon_\beta)^2\left\{1-\exp\left(-\frac{1.47}{\sqrt{\varepsilon_\beta}}\right)\right\}^{-1}d\varepsilon_\beta \tag{24}$$

where k=1/4120 is the constant normalizing factor and $\in_{max}$=18.6 keV, the maximum energy of tritium beta particles. Braun et al., "Theory and Performance of a Tritium Battery for the Microwatt Range," *Journal of Physics E: Scientific Instruments,* 6 (1973); Belovodkii et all., "Tritium", *Energoatomizdat*, Moscow, Russia (1985). The path of beta particle η(U) with energy greater than q·U, which can consequently reach the collector where q is the elementary charge, and U is the voltage on the collector is given by:

$$\eta(U) = \int_{qU}^{\varepsilon_{max}} w(\varepsilon_\beta)\,d\varepsilon_\beta \tag{25}$$

Figure 21:
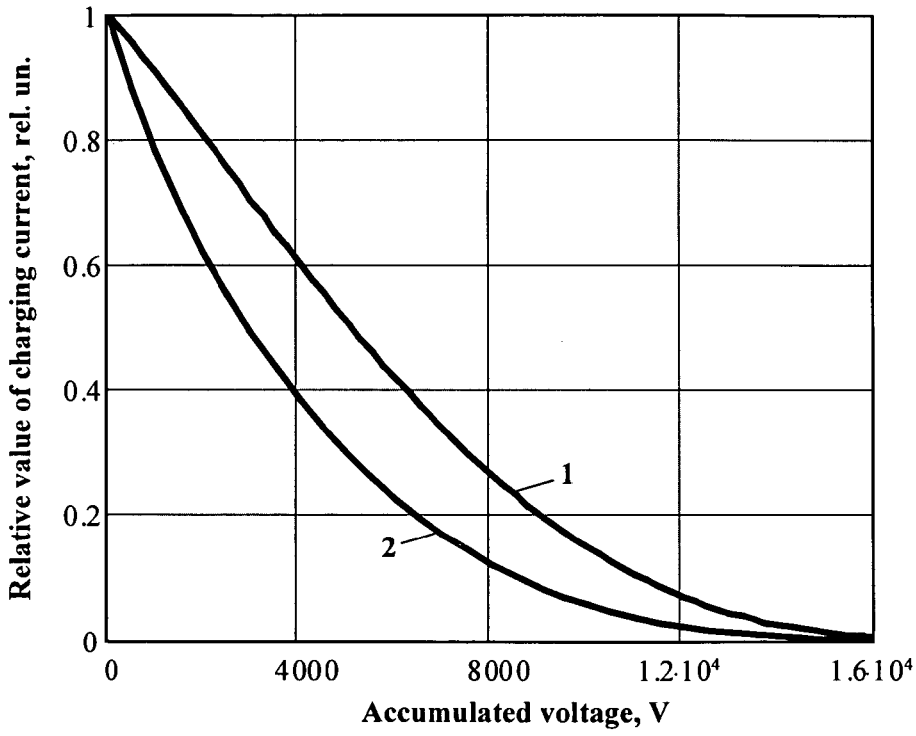
FIG. 21 is a graph depicting the dependence of relative value of charging current on collector voltage in the case of electrodes with 5 cm radii held at 5 mm distance apart: curve 1 was calculated using Equation 25 and curve 2 was calculated using Equation 43.
Figure 22:
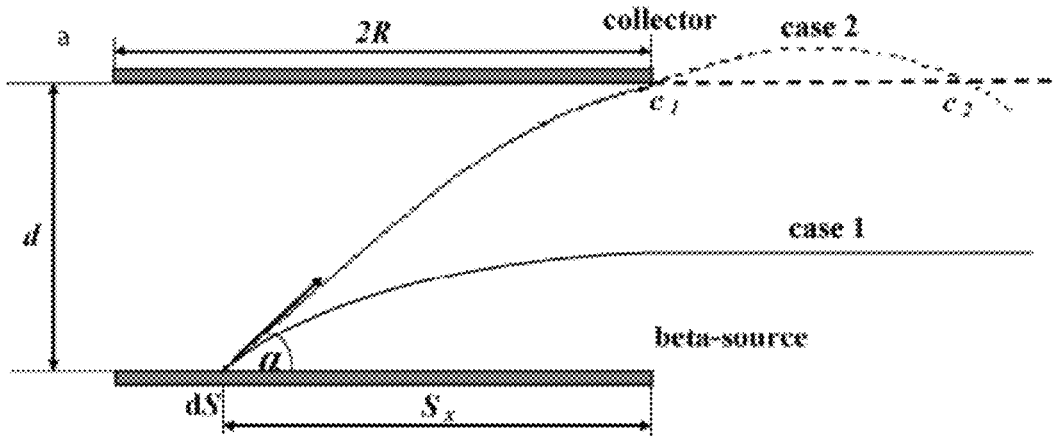
FIG. 22*a* and FIG. 22*b* are drawings showing the effect of building capacitor potential on the trajectories of beta particles, wherein (a) is represent a low potential on the collector and (b) the collector potential can have significant influence on the beta particles.
Figure 22:
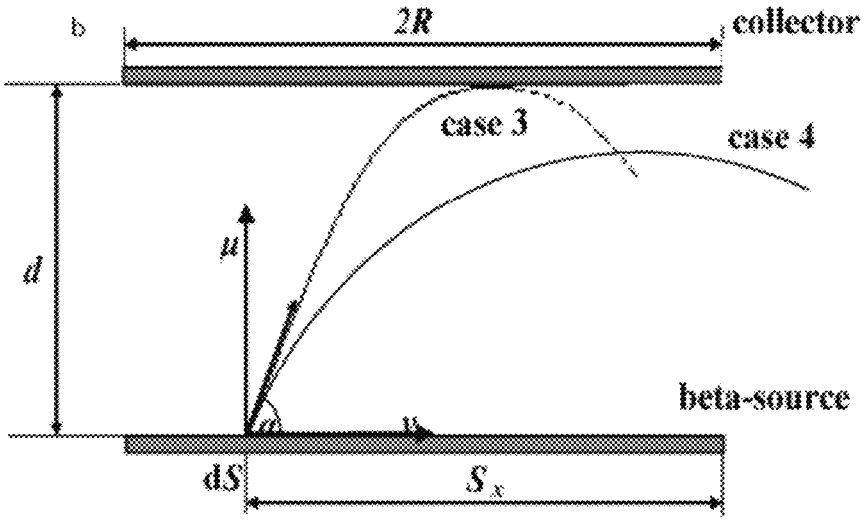

The dependence is plotted on FIG. 21, curve 1, and works for the cylindrical capacitor geometry. For flat capacitors, the effect of the electrical field affecting negatron trajectories to miss the collector plates must be accounted for as is represented in FIG. 22, cases 1 and 4, which are based on Equation 21. The critical angle α under which emitted beta particles will still reach a collector depends not only on a position dS on the surface of the source, but also on the voltage of the collector. For a plane in which the angle α lays, the trajectory of the charged particle in an electric field is parabolic. The maximum trajectory depends on its origin in the source and the magnitude of the electrical field. If the magnitude of the electrical field is not relatively large, the maximum point of the parabola lies outside the collector (FIG. 22*a*). But if the magnitude of the electrical field is relatively large, then the maximum of the parabola lies inside the collector (FIG. 22*b*). If the angle of the beta particle emission is less than α then the particle will miss the collector (case 1 in FIG. 22*a* and Case 4 in FIG. 22*b*).

Additionally, when the electrical field is not relatively large, the value of a critical angle at which the beta particle still reaches the collector is determined from the boundary conditions $$S_x = V\cdot\cos\alpha\cdot t \text{ and} \tag{26}$$

$$d = V\cdot\sin\alpha\cdot t - \frac{a\cdot t^2}{2}, \tag{27}$$

where t is the moment of beta particle emission in seconds and V is the initial speed of the beta particle in meters per second:

$$V = \sqrt{\frac{2\cdot\varepsilon_\beta}{m_e}}\text{, and} \tag{28}$$

where $\in_\beta$ is the energy of the beta particle in joules and $m_e$ is the mass of an electron, ($9.1.10^{-31}$ kg); a is the acceleration of the beta particle caused by interaction with the electric field ($m/s^2$), determined with the formula:

$$a = \frac{q_e}{m_e}\cdot\frac{U}{d}, \tag{29}$$

where $q_e$ is the electronic charge ($1.6.10^{-19}$ C) and U is the voltage between electrodes in volts.

From Equations 26 and 27, $$d = S_x\cdot tg\alpha - \frac{a\cdot S_x^2}{2\cdot V^2\cdot\cos^2\alpha}. \tag{30}$$

And taking into account that $\cos^2\alpha = \frac{1}{1+tg^2\alpha}$, $$S_x\cdot tg\alpha - \frac{a\cdot S_x^2}{2\cdot V^2}\cdot(1+tg^2\alpha) = d. \tag{31}$$

Solving Equation 31, there are two values of a root:

$$tg\alpha_{1,2} = \frac{S_x \pm \sqrt{S_x^2 2\cdot\frac{a\cdot S_x^2}{V^2}\cdot\left(\frac{a\cdot S_x^2}{2\cdot V^2}+d\right)}}{\frac{a\cdot S_x^2}{V^2}}. \tag{32}$$

For these values, the trajectory of the electron movement crossing the collector plane is the point $c_1$ (see FIG. 22*a*). For larger roots, the electron misses the collector. The smaller value of tgα corresponds to case 2, and therefore Expression 32 should use the negative root. Hence, it is possible to determine the critical angle α using:

$$\alpha = \text{arc}tg\left(\frac{V^2\cdot S_x - \sqrt{(V^2\cdot S_x)^2 - a\cdot S_x^2\cdot(a\cdot S_x^2+2\cdot V^2\cdot d)}}{a\cdot S_x^2}\right). \tag{33}$$

If the magnitude of the electrical field is relatively large (FIG. 22*b*), the critical angle gives the maximum trajectory in which the electron reaches the collector. Particles with a starting angle less than a critical angle will not reach the surface of the collector (Case 4 FIG. 22*b*). For planes of an angle α rectangular coordinates (v, μ) with origin dS (FIG. 22*b*), the trajectory of beta particles from an angle α can be written as $$v = V\cdot\cos\alpha\cdot t \text{ and} \tag{34}$$

$$\mu = V\cdot\sin\alpha\cdot t - \frac{a\cdot t^2}{2}. \tag{35}$$

From Equations 32 and 33, $$\mu = v\cdot tg\alpha - \frac{a\cdot v^2}{2\cdot V^2}\cdot(1+tg^2\alpha). \tag{36}$$

If the point of maximum trajectory coincides with the collector plane of a collector, $$\frac{d\mu}{dv} = tg\alpha - \frac{a \cdot v}{V^2} \cdot (1 + tg^2\alpha) = 0 \text{ and} \tag{37}$$

$$d = v \cdot tg\alpha - \frac{a \cdot v^2}{2 \cdot V^2} \cdot (1 + tg^2\alpha). \tag{38}$$

From Equations 37 and 38, $$tg\alpha = \sqrt{\frac{2 \cdot a \cdot d}{V^2 - 2 \cdot a \cdot d}} \text{ or } \alpha = \text{arc}tg\left(\sqrt{\frac{2 \cdot a \cdot d}{V^2 - 2 \cdot a \cdot d}}\right) \text{ and} \tag{39}$$

$$v = \frac{V^2 \cdot tg\alpha}{a \cdot (1 + tg^2\alpha)}. \tag{40}$$

Thus, the angle $\alpha$ in the second case represented in FIG. 22*b* is determined by the Expression 39. Thus, the next condition should be satisfied $$v = \frac{V^2 \cdot tg\alpha}{a \cdot (1 + tg^2\alpha)} \leq S_x. \tag{41}$$

From Equations 39 and 41, $$\sqrt{\frac{2 \cdot d \cdot (V^2 - 2 \cdot a \cdot d)}{a}} \leq S_x. \tag{42}$$

If this condition is not satisfied, the situation reduces to the first case.

The tritium beta particle energy distribution (Equation 24) as fraction $\eta$ of beta particles flux, which reaches a collector, can be taking into account as $$\eta = \int_0^{\varepsilon_{max}} w(\varepsilon_\beta) \frac{1}{\pi R^2} \cdot \int_0^R \int_0^{2\pi} \cos^2\alpha \cdot x \cdot d\,\beta d x d\,\varepsilon_\beta, \tag{43}$$

where $\alpha$ is determined by Expression 33 or Expression 39.

The relative magnitude of the charging current $I_{Ch}$ versus voltage on collector can be calculated as ratio $\eta(U)I\eta(U=0)$. The dependence of $I_{Ch}$ on collector voltage with electrodes of 5 cm radii and distance between source and collector of 5 mm was calculated with Equation 43. Results are graphed in FIG. 21, curve 2. $I_{Ch}$ decreases with increase of voltage between electrodes. At the voltage on collector near 15 kV, the charging current practically equals zero. For a parallel plate charged capacitor, the accumulating electric field inhibits a growing fraction of the beta flux from reaching the collector.

II. Radioactive Source

As mentioned above, the heart of a direct charge beta capacitor is the radioactive source. One aspect of the present is a new radioactive source structure and a method for producing the same that is based on forming a sol-gel derived core that comprises one or more $\beta^-$-emitting radioisotopes. The radioisotope-containing sol-gel derived core is enclosed with an encapsulant that comprises a surface that is in contact with the core, wherein said surface is not an electrolytically deposited metallic coating nor an electroless deposited metallic coating; and at least a portion of the encapsulant is an electrically conductive sheet through which at least some of the $\beta^-$ emissions from the $\beta^-$-emitting radioisotope pass. In certain embodiments, substantially all of the encapsulant comprises one or more electrically conductive sheets through which at least some of the $\beta^-$ emissions from the $\beta^-$-emitting radioisotope pass. Additionally, in certain embodiments, the encapsulated $\beta^-$ particle emitter may be configured so that the encapsulant comprises a cover, which is an electrically conductive sheet, and a substrate, which is an electrically conductive sheet that is thicker than the cover and is able to support the core and cover without substantial deformation.

A. Radioisotopes

The aforementioned $\beta^-$-emitting radioisotope may be essentially any single $\beta^-$-emitting radioisotope or combination of $\beta^-$-emitting radioisotopes. That said, it is believed that the one or more of the following $\beta^-$-emitting radioisotopes are desirable for being utilized in the present invention: $^{3}H$, $^{10}Be$, $^{14}C$, $^{36}Cl$, $^{59}Fe$, $^{60}Fe$, $^{60}Co$, $^{63}Ni$, $^{79}Se$, $^{87}Rb$, $^{90}Sr$, $^{93}Zr$, $^{94}Nb$, $^{98}Tc$, $^{99}Mo$, $^{99}Tc$, $^{106}Ru$, $^{107}Pd$, $^{110}Ag$, $^{111}Ag$, $^{121}Sn$, $^{124}Sb$, $^{125}Sb$, $^{129}I$, $^{134}Cs$, $^{135}Cs$, $^{137}Cs$, $^{144}Ce$, $^{146}Pm$, $^{147}Pm$, $^{151}Sm$, $^{150}Eu$, $^{152}Eu$, $^{154}Eu$, $^{160}Tb$, $^{166}Ho$, $^{170}Tm$, $^{171}Tm$, $^{182}Ta$, $^{185}W$, $^{188}W$, $^{194}Os$, $^{204}Tl$, $^{227}Ac$, $^{228}Ra$, and $^{241}Pu$. Of the foregoing, the properties of and/or the experimental results with the following have shown $^{3}H$, $^{63}Ni$, $^{90}Sr$, $^{147}Pm$, and combinations thereof to be of particular interest. In particular, $^{147}Pm$ has shown an especially desirable set of properties but in certain applications $^{90}Sr$ may be a more desirable choice because its higher energy level should allow for an increase in the beta penetration through multiple collector layers.

In certain embodiments it is desirable for the selected $\beta^-$-emitting radioisotopes to have one or more of the following properties: a suitable half life (e.g., from about one year to ten years), a relatively high amount of $\beta^-$ emissions (e.g. at least about 1 Curie), and a relatively low amount of gamma-ray emissions. By way of example, the characteristics of tritium and promethium-147 are set forth in the Table C, below.

TABLE C

| | | Radiation | | Carrier | |
|---|---|---|---|---|---|
| Isotope | Half-life Years | β $\epsilon_{av}/\epsilon_{max}$, keV | γ $\epsilon_\gamma$, keV/yield | Compound | $A_{sp,max}$ Ci/mg |
| tritium ($^{3}H$) | 12.3 | 5.7/18.6 | none | $TiT_2$, $ScT_2$ | 1.1 |
| $^{147}Pm$ | 2.6 | 62/223 | 121/0.0000285 | $Pm_2O_3$ | 0.8 |

Typically, the foregoing $\beta^-$-emitting radioisotopes are in the form of compounds. For example, many of the $\beta^-$-emitting radioisotopes are in the form of oxides (e.g., $Pm_2O_3$), salts such as chlorides (e.g., $NiCl_2$, $SrCl_2$, $FeCl_3$) and nitrates (e.g., $(UO_2(NO_3)_2)$, a water soluble yellow uranium salt) or other compounds (e.g., $Ti^3H_2$ and $Sc^3H_2$).

Notwithstanding all the possible compounds that may comprise the $\beta^-$-emitting radioisotopes, in certain embodiments of the present invention it is preferable that the $\beta^-$-emitting radioisotopes be in a form that is at least substantially soluble in an alcohol. The reason for this is that dissolved $\beta^-$-emitting radioisotope(s) tend to be more readily mixed with or in a sol-gel formation and facilitate the formation or maintenance of a substantially uniform concentration of the $\beta^-$-emitting radioisotope(s) in the sol-gel formulation with little or no agitation or mixing. It should also be noted, that the soluble $\beta^-$-emitting radioisotope(s)-containing compound(s) may be mixed directly into a sol-gel formulation for dissolution or they may be dissolved in a "carrier" solvent, which is then added to the sol-gel formulation.

Although it is desirable in certain embodiments for the $\beta^-$-emitting radioisotope(s) to be soluble, it is possible to select compounds comprising the $\beta^-$-emitting radioisotope(s) that are not substantially soluble in an alcohol (i.e., a substantially insoluble compound). In such embodiments, the particles of the $\beta^-$-emitting radioisotope(s)-containing compounds may be mixed or dispersed within the sol-gel formulation. Depending upon the particular sol-gel formulation and $\beta^-$-emitting radioisotope(s)-containing compound particles, the particles may be readily dispersed in the sol-gel formulation, with the dispersal being readily uniform with just the mixing or agitation that is necessary to achieve the initial dispersal. Alternatively, it is foreseeable that some degree of agitation or mixing may be necessary to prevent a non-uniform dispersion (e.g., as the result of settling).

B. Sol-gel Derived Glass Containing Radioisotopes

As indicated above, certain aspects of the present invention relate to including one or more $\beta^-$-emitting radioisotopes in sols or sol-gels and using the same to form coatings from said sol-gels. Sol-gels and techniques for forming and using the same are widely known and the subject of publications. Sol-gel chemistry facilitates efficient trapping of metal ions, organic compounds and polymers in a durable inorganic matrix. Hench et al., Chem. Rev. 90 (1990) 33; Wilkes et al., Chem. Mater. 8 (1996) 1667; and Mark, Heterogeneous Chemistry Reviews 3 (1996) 307.

In general, the sol-gel process is a wet-chemical technique for fabricating materials (typically a metal oxide) starting either from a chemical solution or liquid suspended colloidal particles (both of which are commonly referred to as a "sol") to produce an integrated network (commonly referred to as a "gel"). Typical sol precursors include metal alkoxides, metal chlorides, and organometallic compounds in a suitable solvent to form the sol. The dissolved metal alkoxides, metal chlorides, or organometallic compounds (i.e., the sol-gel precursors) tend to hydrolyze, partially or completely, in water, acid/base, or other solvent and then condense/polymerize resulting in gelation. In particular, the polymerization involves the metal centers with oxo (M-O-M) or hydroxo (M-OH-M) bridges, therefore generating metal-oxo or metal-hydroxo polymers in solution.

Suitable metal alkoxides include alkoxides of silicon, titanium, boron, zirconium and other transitional elements, and combinations thereof. In particular, experimental results to date indicate that silicon alkoxides alone or in combination with titanium alkoxides are fine choices for the sol precursors. More specifically, in such silicon-titanium alkoxide-based sol-gel formulations, the amount of titanium containing compounds (e.g., alkoxides, oxides, organometallics) in the sol, the gel, the dried gel, and/or the thermally treated material is preferably no greater than about 40 percent by weight of the sol, the gel, the dried gel, and/or thermally treated material, respectively. By way of example, some commonly used sol-gel precursors include tetraethyl orthosilcate (TEOS), glycidoxypropyltrimethoxysilane (GPTMS), tetramethyl orthosilicate (tetramethoxysilane) (TMOS), titanium isopropoxide, and many others.

To form the radioisotope-containing sol, it is generally preferred to use as little sol as possible, depending upon the particular deposition method, because with more material more of the $\beta^-$ emissions will tend be absorbed and less flux will emerge from the surface. As such, it is typical to use only enough sol as to wet and/or dissolve the desired amount of radioisotope. Additionally, when the sol-gel precursors are mixed to form the sol, it tends to be preferred to allow the reaction to proceed in an anhydrous or inert atmosphere because the some portion of the reagents may react with moisture in the atmosphere instead of each other.

The sol can be either deposited on a substrate by any suitable method to form a relatively thin layer or film (e.g. by dip-coating, spin-coating, casting into a depression of a suitable shape formed in a substrate, ink-jet printing, spraying, electrophoresis, roll coating, etc.). The sol-gel approach is considered to be advantageous because it is a relatively inexpensive and simple technique that does not require high temperatures, while still allowing for the fine control on the product's chemical composition to include, among other things, dopants such as $\beta^-$-emitting radioisotopes that can be readily dissolved or dispersed therein. As mentioned above, although it is possible for the concentration of radioisotope(s) to be non-uniform throughout the sol-gel such that upon curing the core has a concentration of radioisotopes that is non-uniform, this configuration usually not considered to be desirable. Instead, it is generally preferred for the concentration of radioisotope(s) in the sol-gel to be uniform.

To enhance the adhesion between the sol-gel/sol-gel derived core and a material it is deposited on and/or in contact with, a coupling agent may be utilized. The coupling agent may be applied to the substrate, it may be included in the sol-gel, or a combination of the two may be utilized. Preferable coupling agents have alkoxy and amino silane functionalities. Of particular interest is glycidoxypropyltrimethoxysilane because it can be readily included in a variety of sol systems. If a coupling agent is deposited on the surface of the substrate, the amount need only be sufficient to cover the surface in contact with the sol-gel. Additionally, the adhesion may be enhanced by utilizing a cleaning agent on the substrate. Examples of cleaning agents include a dilute acid solution, a soap solution, and an alcohol.

After deposition, the sol-gel is preferably allowed to cure for a sufficient amount of time to essentially complete the polymerization reaction, which also tends to improve the adhesion of a sol-gel to a substrate the sol-gel is in contact. Although the amount of time necessary to cure a sol-gel can vary depending on the sol-gel composition and the conditions, typically, at room temperature, a curing period of about 12 to about 24 hours is sufficient. The cured sol-gel may be (and preferably is) subjected to a thermal treatment that may, for example, (a) remove volatile species, including but not limited to alcohol or residual organic groups, (b) result in processes which produce shrinkage and removal of residual porosity, and/or (c) result in processes that involve phase changes, including crystallization and chemical reactions, to yield a relatively dense ceramics that may be crystalline or amorphous. Although the particular conditions for the heat treatment may be varied, it is typically carried out at a temperature(s) between about 60° C. and about 80° C. for a duration of about 12 hours. Thus, the cured, and optionally thermally treated, sol-gel forms a solid radioactive oxide coating comprising an oxide and a radioisotope.

It should be noted that a substrate may be coated with multiple layers of sol or each of which may comprise one or more $\beta^-$-emitting radioisotopes or some of which may be at least substantially free of $\beta^-$-emitting radioisotopes. For example, it may be desirable to protect or encapsulate a sol-gel derived layer comprising a $\beta^-$-emitting radioisotope with a layer sol-gel derived layer that is free of $\beta^-$-emitting radioisotopes ("clean" sol). In fact, in certain instances it may be desirable to deposit a small amount of clean sol on a cover (e.g. 1-2 μm thick Al foil) before placing the cover on the radioactive sol. This wets the cover with sol and tends to improve adhesion between the cover and the radioactive layer. Additionally, it is possible for multiple radioactive coating layers to be the same or different.

The sol-gel method provides an efficient and safe way of handling and depositing radioisotopes for use in power supplies, medical devices, and calibration sources. The sol-gel method, depending upon the desired radioisotope, can eliminate or minimize the use of high activity powders thereby eliminating or minimizing risks and costs associated therewith (e.g., health, safety, environmental, equipment, etc.). As a further benefit, the isotopes are within a thin-film glass matrix that serves as both window and primary containment. Lastly, it should be noted that other dopants that may be added to the sol-gel include phosphors which in combination with a $\beta^-$-emitting radioisotope can provide a self luminescent coating.

C. Encapsulation of the Radioactive Sol-Gel

As described above, the radioactive sol-gel may be deposited by any appropriate means onto a substrate, which acts as part of the encapsulant enclosing the sol-gel derived core, thus a surface of the substrate is in contact with the sol-gel, which ultimately becomes the solid sol-gel derived core. Preferably, at least some portion of the substrate, more preferably the portion corresponding to the surface in contact with the sol-gel, allows at least some of the $\beta^-$ emissions from the $\beta^-$-emitting radioisotope to pass. Still more preferably, said portion of the substrate or even the entire substrate is an electrically conductive substrate or sheet. The sol-gel derived core may also be covered with a sheet. It is important to note that one of said sheets should be of sufficient thickness that is above to support the core and the other sheet, which can be substantially thinner because it need only cover the core, without substantial deformation. Of course, it is understood by those of skill in the art that it is desirable to minimize the thicknesses of the base and cover in order to maximize the $\beta^-$ emissions that pass through the same.

Additionally, it is within the skill of the art to select the appropriate thicknesses depending upon the particular physical properties of the material. In general, it is desirable to select materials of sufficient strength that have a relatively low density. Experience to date has shown that the density of the materials used to encapsulate the radioactive sol-gel derived core is preferably no greater than about 9 g/cm$^3$, and then of if the encapsulated source is thin. Keeping in mind the consideration of mass thickness, which is the product of density and thickness, it is preferred that the materials selected to encapsulate the radioactive sol-gel derived core are such that the substrate, which provides the majority of the structural integrity for the encapsulate source, as a mass thickness that is no greater than about 2.5 mg/cm$^2$ and the cover has a mass thickness that is no greater than about 0.6 mg/cm$^2$.

In view of the desired physical characteristics of the encapsulant (e.g., electrical conductivity, density, thickness, mass thickness, strength, stiffness, etc.) it is preferred that the electrically conductive sheet(s) (e.g., substrate and cover) that encapsulate the sol-gel derived radioactive core comprise one or more elements selected from the group consisting of Be, Al, and Ti. Experimental results to date have shown aluminum or low-density aluminum-based alloys to be an excellent choice of material. In particular, for 4π sources, $\beta^-$ particle emission efficiencies of at least about 50% may be achieved when utilizing an aluminum or aluminum-based alloy substrate having a thickness that is no more than about 8 μm and cover having a thickness that is no more than about 2 μm.

Notwithstanding the foregoing concerning $\beta^-$-emitting radioisotope(s) in sol-gel formulations, it is possible to practice certain aspects of the invention disclosed herein using a $\beta^-$-emitting source or layer that is formed or created without using a sol-gel derived glass for containing the radioisotopes. For example, a $\beta^-$-emitting source or layer may be formed by reacting a sol-gel coating with tritium gas ($^3$H), when the cover is less than a micron thick.

III. Dielectric

As described above, a $\beta^-$ capacitor comprises a dielectric between the emitter and the collector. The dielectric may be a vacuum or any other appropriate electrically insulating material (liquid or solid). That said, when selecting the dielectric many factors are likely to be taken into consideration, including ease of manufacture, cost, size, application, weight, durability, current, voltage, etc. It is generally desirable to maximize the number of beta particles from the emitter that reach the collector. In view of this, it is generally preferred that the dielectric has, among other things, a relatively low density, a sufficient dielectric strength, pin-hole free, and a relatively high permittivity, which allows a greater charge to be stored at a given voltage. Importantly, in this particular application, it is also desirable for the dielectric to resist degradation due to the $\beta^-$ emissions passing through the dielectric.

In general, it is desirable for the material(s) utilized as the dielectric to have one or more of the following characteristics: relatively high dielectric strength (e.g., at least about 200 V/micron), a relatively high volume resistivity (e.g., at least about $10^{14}$ ohm*m), a relatively low density (e.g., no more than about 2.5 g/cm$^3$). Polyimide, silica, and other metal oxides may be used to provide a relatively radiation-resistant, electrically insulative material for use as a dielectric.

IV. Secondary Electron Suppression

In certain embodiments of the present invention, it may be desirable to implement or include measures or components within the capacitor to reduce, minimize, or suppress the emission of secondary electrons from the collector caused by the impact of the $\beta^-$ emissions (electrons) from the emitter. The number of secondary electrons emitted are often referred to as secondary emission yield. In particular, it may be desirable to cover at least the portion of the surface of the collector that the $\beta^-$ emissions may impact with a coating or layer that suppresses the emission of secondary electrons. Despite increasing the distance and the amount of material between the emitter and the collector, which would tend to decrease the amount of $\beta^-$ emissions that reach the emitter, the inclusion of the suppression coating decreases the amount of secondary emissions such that overall there is a gain in conversion efficiency.

In general, it is desirable for the material(s) utilized as the secondary electron suppressor to have a relatively high dielectric strength, a relatively high volume resistivity, and a relatively low density. Carbon-containing compounds or materials such as graphite and organic polymers tend to have relatively low secondary electron emissions. Depending upon the design it may be able to utilize this characteristic with other characteristics of the materials in the direct charge capacitor of the present invention. For example, depending upon the desired application it may be beneficial to utilize electrically conductive forms of carbon (e.g., graphite or carbon nanotubes) or electrically conductive polymers (e.g., poly(phenylene vinylene)) as a coating on a metal collector or even as the collector. Graphite has been shown to be an excellent material for this purpose. Rappaport et al., Radioactive Charging Effects with a Dielectric Medium, Journal of Applied Physics, (24)9, (1953). Alternatively, it may be beneficial to utilize an electrically insulating material which can function as both the dielectric and secondary electron suppressor.

Regardless whether electrically conductive or insulating material(s) are utilized, it is desirable for the material(s) to resist degradation of their particular combination of desired properties due to the $\beta^-$ emissions. Because of this, radiation-resistant polymers (e.g., polyimides, polyetherimdes, polyamideimides, polyphenylene sulfides, polyetheretherketones, polystyrenes, polyarylates, polyarylamides, polyethersulfides, polysulfones, polyamides, polyphenyloxides, etc.) are preferred over aliphatic polymers (e.g., polyethylene, polypropylene, polymethyl methacrylate, polyoxymethylene, etc.) Furthermore, halogenated polymers such as polytetrafluoroethylene, are usually not desirable polymers. Experimental results to date show that polyimides tend to be have a relatively good radiation stability and electrically insulative properties such that it may be used effectively as a dielectric material and a secondary electron suppressing layer when configured between the emitter and the collector. Depending upon the parameters of the particular application, the secondary suppression layer and/or dielectric may be a thin, relatively dense film (see, Table D, below, which was tabulated from data at www.polifibra.com). Experimental results to date indicate that thin polyimide films have desirable properties.

TABLE D

| Polyimide film thickness (mil) | Dielectric strength (V/mil) | Volume resistivity (ohm · m) |
|---|---|---|
| 1.0 | 7000 | 1.0E+18 |
| 2.0 | 5400 | 8.0E+15 |
| 3.0 | 4600 | 5.0E+15 |
| 5.0 | 3600 | 1.0E+15 |

V. Examples

A. Tritium Direct Charge Experiments

Figure 23:
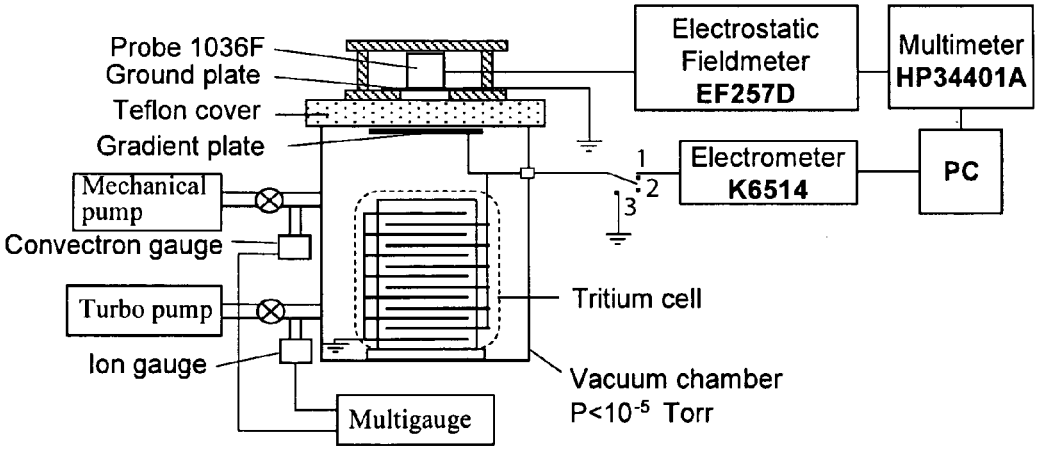
FIG. 23 is a schematic drawing of a tritium direct charge experimental setup.

A tritium direct charge capacitor was produced and tested to study certain principles set forth herein. Referring to FIG. 23, the direct charge experimental setup 50 comprised a tritium cell 51 that comprised 24 unit sets each with a source 52 and a collector 53 arranged so that the distance between them was about 5 mm. The activity of tritium in each source was approximately $5.9\cdot10^{10}$ Bq (1600 mCi) for a total of about $1.4\cdot10^{12}$ Bq (38 Ci). More particularly, the sources were stainless steel disks (diameter of 10 cm and thickness 0.5 mm), wherein one or both side of each disk was coated with 300 nm scandium, which was saturated with tritium gas. The collectors were of the same size and material of construction as sources.

The tritium direct charge experimental setup also comprised a vacuum chamber 54, electrical feed-through 55, and measurement devices. The vacuum chamber 54 had two ports: one for a low vacuum line (mechanical pump) 57 and the other for a high vacuum line (turbo molecular pump) 58. The level of vacuum in the vacuum chamber was pumped below $10^{-5}$ torr. The measurement devices were: a convectron gauge 56 and the ion gauge 59 were used for the measurement of residual pressure in the chamber; a Keithley 6514 Electrometer for measurement of the charging current 60; an electrostatic field meter (Monroe Electronics 257F with probe 1036F) 61 for measurement of the accumulated voltage. The 2 cm thick cover 62 of the vacuum chamber 54 was made from Teflon. On the inner side of the cover 62 was a metal gradient plate 63 for the electrostatic field meter 64. On the external side of the cover 65 was positioned the probe 66 with ground plate 67. Before carrying out experiments, calibration of the high voltage measure system based on the electrostatic field meter was performed. The gradient plate 63 was connected with a high voltage power supply 68 (Keithley 248) and the reading of the electrostatic field meter (r) was calibrated against the high voltage (U). This dependence is linear going through the origin. The calibrated relation used to determine the high accumulate voltage value was U=39600·r. Additionally, the described experimental setup was placed in the fume hood (not depicted) for safe handling of tritium sources.

Figure 24:
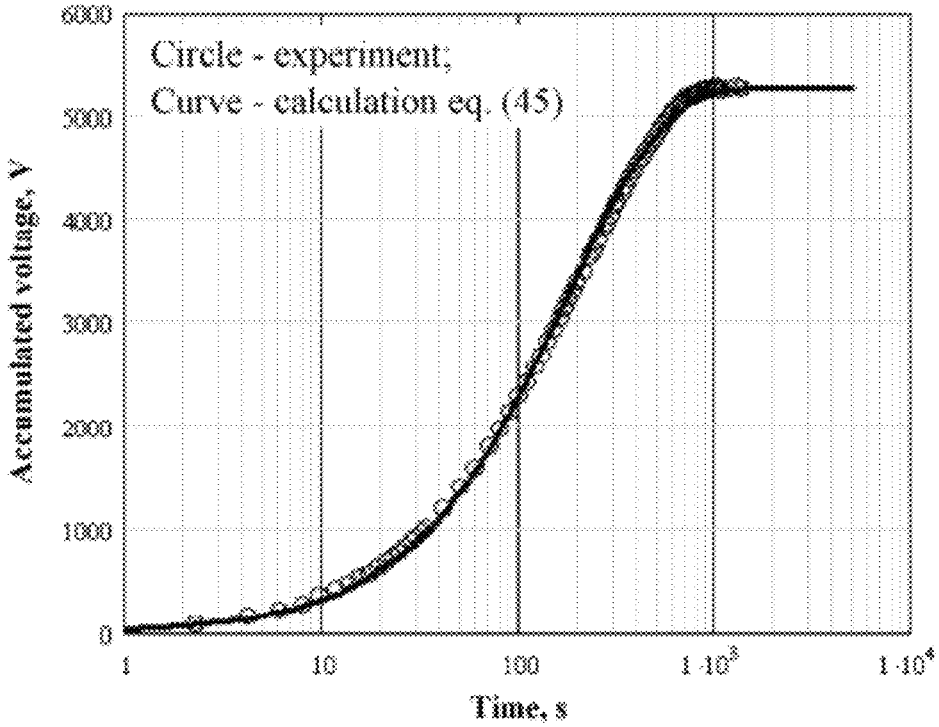
FIG. 24 is a graph showing the dependence of accumulated voltage on collector of a tritium direct charge capacitor with time; the curve is the solution to Equation 45 and the circles are experimental results.

Results of experiments are shown in FIG. 24 in circles. The voltage reached 5300 V after 10 min using a charging current of 148 nA. Taking into account the dependence of charging current on collector voltage, the charging with time was calculated with Equation 3.

$$I_{sc}\cdot\frac{\eta(U)}{\eta(0)} = I_{sc}\cdot f(U), \tag{44}$$

where f(U) are represented in FIG. 3. With this, the charging equation is $$\frac{dU(t)}{dt} + \frac{U(t)}{R_{leak}\cdot C} = \frac{I_{sc}\cdot f(U)}{C}. \tag{45}$$

The numerical solution to Equation 45, which includes the increasing repulsion of the beta particle for the building charge on the collector, is shown by the curve in FIG. 24. The fit leakage resistance and capacitance was 130 GΩ and 4.4 nF, respectively. The measured capacitance was 3 nF.

The agreement between experiments and calculation are good. The I-V characteristics of the tritium charged capacitor then takes into account the most relevant features, $$U_{sat}=I_{sc}\cdot R_{leak}\cdot f(U_{sat}), \tag{46}$$

and Equation 7 can be written as $$I_{load} = I_{sc}\cdot\left[f(U_{sat}) - \frac{U_{sat}}{U_{oc}}\cdot f(U_{oc})\right]. \tag{47}$$

From the I-V curve it is possible to determine the optimal load resistance, r, as $I_{load}\cdot U_{sat}$. For this tritium charged capacitor ($I_{sc}$=148 nA, $U_{oc}$=5300 V), the voltage at 2300 V gave the highest electrical power at 160 uW. The load resistance on which can be received the maximal useful electrical power should then be equal 35 GΩ. The efficiency of this tritium charged capacitor was estimated as 160 uW/(38 Ci·3.7.10$^{10}$ Bq/Ci·5.7 keV·1.6.10$^{-16}$ J/keV)·100%=12.5%.

B. Radioisotope Loaded Sol-Gel Coatings

The chloride salts of nickel, iron and strontium, and uranyl nitrate have been used as surrogates for Ni-63, Fe-59, Sr-90, and actinides, respectively, to prepare metal salt loaded sol-gel coating materials for deposition on voltaics and radioisotope batteries. Transparent coating materials based on an inorganic-organic hybrid sol with salt loadings up to 25% nickel chloride, 6% ferric chloride, 14% strontium chloride and 90% uranyl nitrate were prepared.

The inorganic-organic hybrid sol was prepared by mixing a silica sol and a titania sol. The colorless and transparent silica sol was prepared by the reaction of GPTMS with TMOS. Specifically, the silica sol was prepared by mixing 0.06 mol of glycidoxypropyltrimethoxysilane (GPTMS) and 0.02 mol of tetramethoxysilane (TMOS) in a polypropylene flask under nitrogen while 1.0 ml of 0.1 M acetic acid was added dropwise. The reactants were continuously stirred during addition. The silica sol solution was aged for a few days.

The titania sol was prepared by the reaction of titanium isopropoxide with dilute HCl in deionized water and isopropyl alcohol (IPA). Specifically, the titanium isopropoxide dissolved in isopropyl alcohol, the deionized water, and the hydrochloric acid were mixed together at a 7.5:1.0:0.06 mole ratio. Partial hydrolysis and condensation takes place to furnish the titania sol as depicted below.

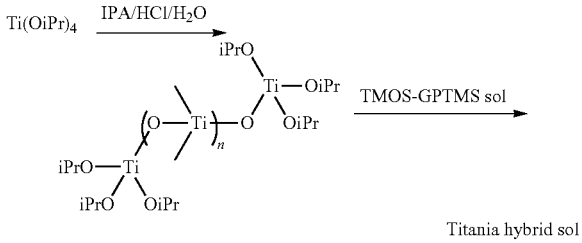

The hydrolysis and condensation of titanium alkoxide tends to be faster than similar reactions with silicon alkoxide. To slow down the reaction and avoid precipitation, water was mixed with HCl and diluted with IPA. A slow addition of this solution to titanium isopropoxide maintained a clear homogeneous titania sol.

The pure titania sol on casting and drying did not give a sturdy film, but rather cracks into small shiny shards. But the addition of the silica sol to the titania sol at various ratios added plasticity to the system. When combining the silica and titania sols, they were mixed together for approximately one hour before being deposited on substrates.

1. Sol-Gel Coatings Loaded with Uranium

Figure 16:
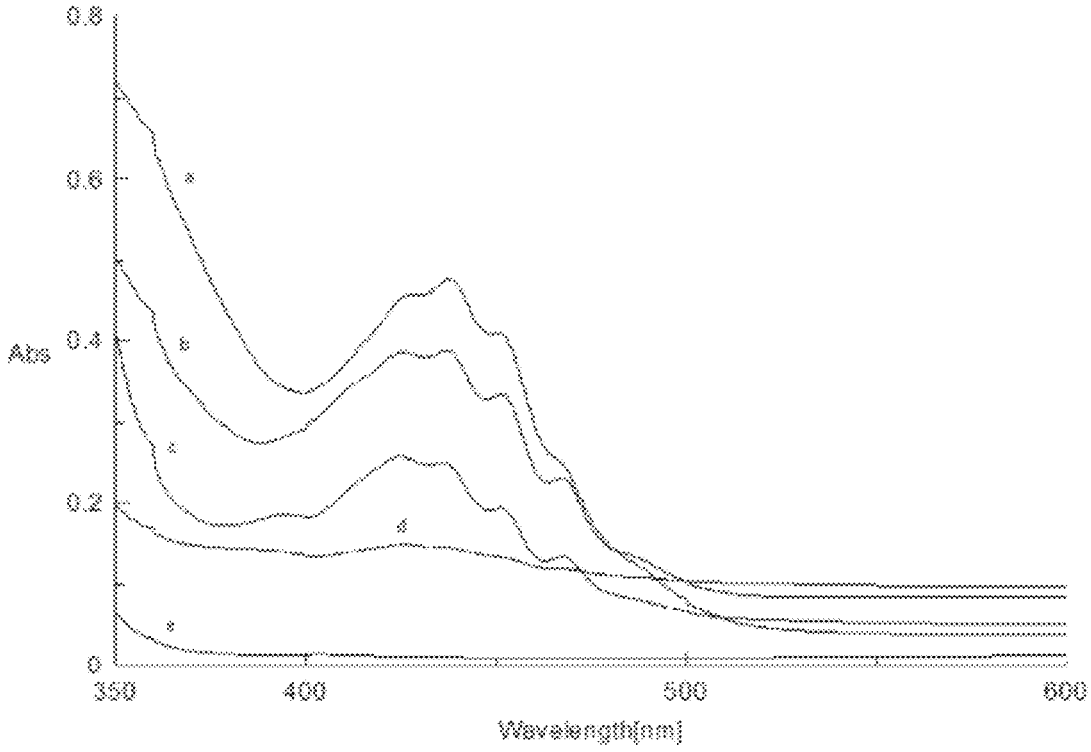
FIG. 16 is a graph showing the visible absorption spectra of uranyl nitrate titania-silica sol coatings on glass at uranyl nitrate loadings of (a) 90%, (b) 78%, (c) 48%, (d) 31%, and (e) 0%.
Figure 17:
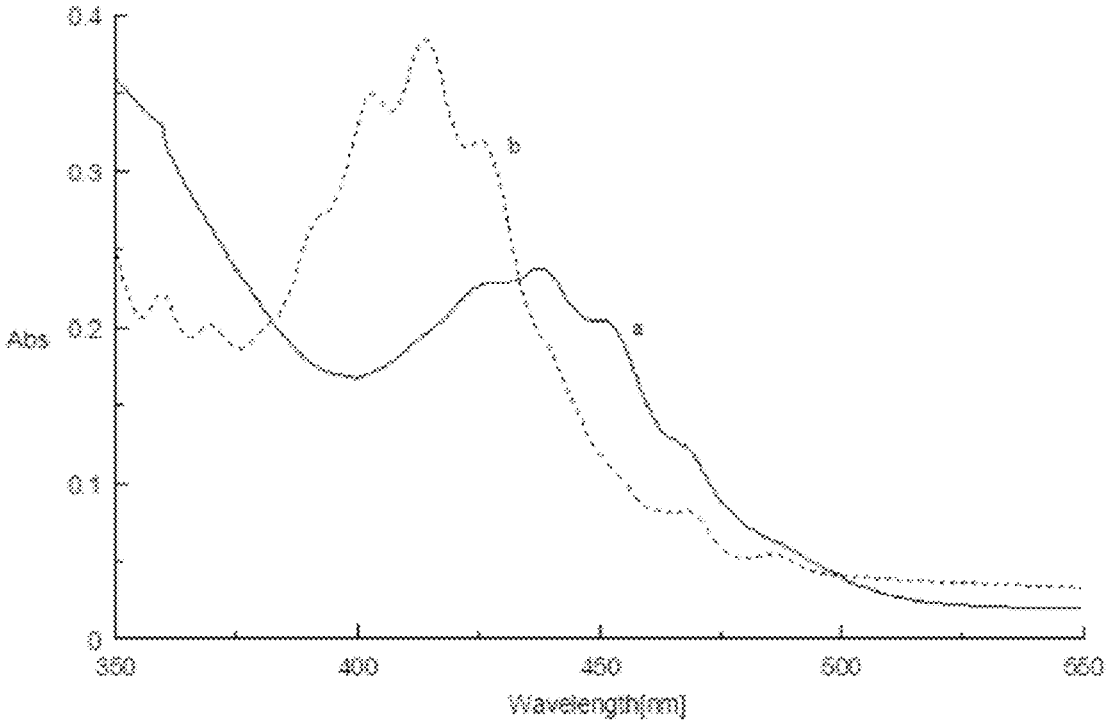
FIG. 17 is a graph showing the normalized absorption spectra of (a) 80% uranyl nitrate-titania sol and (b) uranyl nitrate solution in water.

The sol-gel coatings of uranyl nitrate in silica-titania hybrid system were prepared with a broad range of uranium concentrations in the sol. The sol was loaded with up to 90% w/w uranyl nitrate. Specifically, the uranium-doped silica-titania sol was prepared by addition of varying concentrations of uranyl nitrate in isopropanol to titania-silica sol solution. The hybrid sol solutions were stirred for one hour before coating on substrate. Transparent films of the various uranyl nitrate concentrations were coated on glass, aluminum, and photovoltaic cells. On drying, shiny golden and transparent films resulted with excellent adhesion. The visible absorption spectra of uranyl nitrate loaded titania sol coatings on glass is shown in FIG. 16. The absorption bands appeared at 425, 438, 452, 468, and 490 nm and the intensity of bands increased with higher uranyl loading. In samples with less than 50% loading, an absorption band was present at 359 nm, which disappeared at higher uranyl concentration. The absorption spectrum of loaded sol, showed a 22-26 nm shift to longer wavelength when compared to spectrum of uranyl nitrate in water (FIG. 17), which had absorptions at 359, 370, 392, 403, 415, 426, 444, 470, and 487 nm. These transparent coatings showed good adhesion to substrate with no peeling or cracking, even when heated to 120° C. under vacuum. The color turned orange above 120° C., similar to that of Mexican Fiestaware® uranium glaze.

The treatment of substrate with a coupling agent (GPTMS) pre-wash prior to coating gave a marked improvement in adhesion. The use of a cross-linking agent, diethylenetriamine, in sol was explored. A thin coating adhered well, but cracks appeared in thicker coatings.

2. Nickel Chloride Doped Sol-Gel

Figure 18:
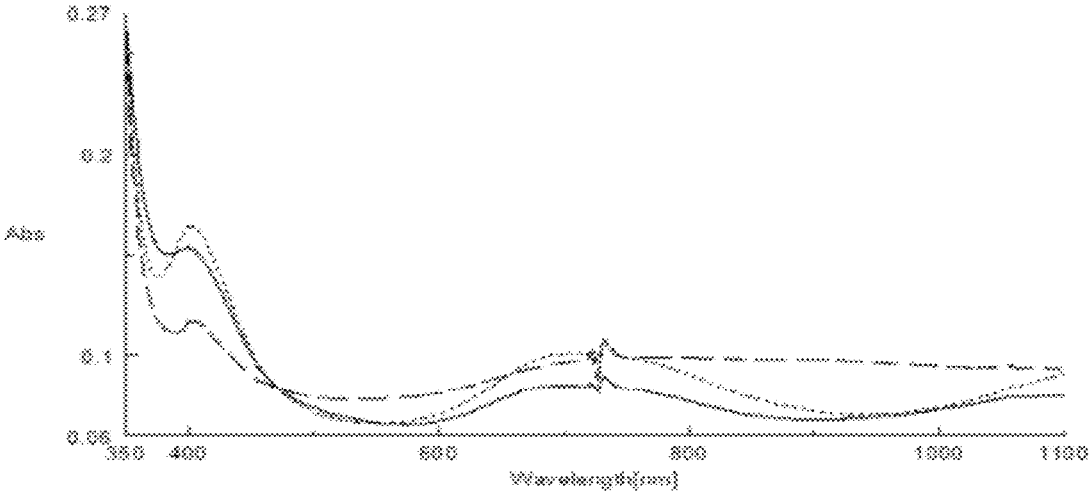
FIG. 18 is a graph showing the visible absorption spectra of nickel(II)chloride in titania sol at a 20%, 5%, and 18% salt loading in acidic sol.

Addition of nickel chloride solution in isopropanol to silica-titania sol gave a clear, light green, solution. This was applied to glass to give transparent coating with excellent adhesion. $NiCl_2$ has a limited solubility in isopropanol, so to increase the salt concentration in the coating, the solubility of the salt in ethanol and its compatibility with the sol system was tested. The $NiCl_2$ solution in ethanol when mixed with titania sol gave a green viscous solution. Concentrations of 5, 15, and 20 weight percent nickel chloride in sol were prepared and applied on glass and aluminum substrates. After drying at room temperature, the coatings were cured at 80° C. for 4 hours. The adhesion to glass and aluminum was good. In the UV-visible spectra shown in FIG. 18, the absorption bands at 402 nm ($\lambda_{max}$), 725 nm, and 1100 nm were consistent with spectra reported for Ni(II) complex in A. F. Schreiner and D. J. Hemm, *Inorg. Chem.,* 12 (1973) 2037.

The deposition of $NiCl_2$ in acidic medium was attempted to better accommodate the form of commercially available Ni-63. Amersham Biosciences Corporation provides Ni-63 as nickel(II)chloride in 0.1 M HCl with activity to 10 mCi/mg Ni, so to optimize the deposition conditions in the presence of an acid, 1.0 M nickel chloride in ethanol was mixed in stoichiometric ratio with titania-silica hybrid sol, prepared from the reaction of titania sol with GPTMS-TMOS sol. Titania hybrid sol samples with 10-25% $NiCl_2$ loading were prepared. In each case, enough 0.1 M HCl was added to maintain a sol:HCl ratio of 8:1 (v/v). The mixed sol solution, which was transparent and green in appearance, was stirred for 45 minutes and then applied to glass. The sol:$NiCl_2$:HCl combination of 8:2:1 gave a transparent coating. Increased nickel content (8:4:1 through 8:6:1) turned turbid after a few minutes but the extended room temperature curing before coating made it transparent. The $NiCl_2$ solution in 0.1 M HCl was not directly mixed with titania sol, since this tends to cause precipitation of titanium. There was not much difference in UV-Vis spectra of $NiCl_2$ doped sol, with and without HCl addition (see FIG. 18). The coatings showed excellent adhesion to glass and aluminum and were stable after annealing at 70° C., to water, methanol, acetone, and dilute hydrochloric acid. The nickel doped sol adhered well to the surface of photovoltaics (GaAs and Si). The coated film was firm and hard. ASTM Method D3363-00, equivalent to ISO15184, gave a hardness greater than 2H. With this methodology, Ni-63 can be safely applied to metal, glass, and other substrates.

3. Strontium Chloride Deposition

Methanol is the solvent of choice for deposition of $SrCl_2$ due to its relatively low solubility in ethanol and isopropanol. Dilute solution of strontium chloride in methanol, when mixed with titania-silica sol produced a transparent coating. Titania hybrid sol samples doped with 4.5, 9.5, 13.5, and 19% w/w $SrCl_2$ were prepared. The coating from the 4.5% $SrCl_2$-sol, prepared after one hour stirring was transparent with good adhesion but the others showed phase separation. Overnight curing of sol mixtures resulted in homogeneity and transparency of coatings with 9.5 and 14% salt content. The films had hardness of 2H. $SrCl_2$ loadings in sol up to 30% were achieved with minor phase separation, using moderate curing conditions.

4. Ferric Chloride Deposition 0.5M ferric chloride in isopropanol was added in stoichiometric proportions to the titania-silica sol. Sample sols with 2.1, 4.2, and 5.9% ferric chloride loading were prepared by this method. The doped sol solutions were cured overnight before deposition on substrates. After room temperature drying, the coatings were cured at 65-70° C. for at least six hours. The cured coatings were firm, transparent, and light yellow in color. The adhesion to substrates was good. The hardness of 2.1, 4.2, and 5.9% (w/w) ferric chloride doped coatings was 5H, 3H, and 2H, respectively.

The deposition of ferric chloride in acidic medium was attempted due to the availability of Fe-59 in 0.1 M HCl with activity up to 25mCi/mg iron. The hybrid sol was mixed with 0.5 M ferric chloride in isopropanol and 0.1 M HCl in stoichiometric ratios. The coating materials with sol: $FeCl_3$: HCl ratios of 5:1:1, 6:2:1 and 6:3:1 (v/v) were prepared. The resultant yellow colored material resulted in transparent and hard coatings (i.e., 5H).

C. $^{147}$Pm Source Efficiency Experiments $^{147}$Pm-containing sol-gel derived radioactive source layers were made by depositing a sol made as described below onto an aluminum substrate that was about 6-8 μm thick (mass thickness of about 1.62-2.16 mg/cm$^2$) and then covering the same with an aluminum foil that was about 1-2 μm thick (mass thickness of about 0.27-0.54 mg/cm$^2$). Some of the characteristics of examples sources are shown in Table E, below.

The sol was made as follows by mixing silica-glycidoxypropyltrimethoxysilane sol and titania sol at a 2:1 ratio to make a silica-titania sol solution for encapsulation and deposition of radioisotope on metal substrate. To prepare the silica-glycidoxypropyltrimethoxysilane sol, 13.2 ml of glycidoxypropyltrimethoxysilane (GPTMS) and 2.9 ml of tetramethoxysilane (TMOS) were mixed with fast stirring under nitrogen and then 1.0 ml of 0.1 M acetic acid was added slowly while stirring. The stirring was continued for three hours and the resultant sol solution was cured for several days. The titania sol was prepared by the reaction of titanium isopropoxide with dilute hydrochloric acid solution from isoproyl alcohol, deionized water, and hydrochloric acid mixed in 7.5:1.0:0.06 mole ratio.

The substrates and the deposited sol were either in the shape of a circle or a rectangle with the active area (i.e., the area of the radioactive layer) as set forth in Table E, below.

TABLE E

| source ID/source shape | Active area (cm$^2$) | Mass thickness (mg/cm$^2$) | Specific activity (Ci/mg) | Activity as made (Ci) | Measured current (nA) | Geom. Factor/ collector configuration | Source Efficiency, % Calculated | Source Efficiency, % Measured |
|---|---|---|---|---|---|---|---|---|
| 1 Circle | 5.1 | 4.40 | 0.097 | 2.14 | 1.86 | 0.43 parallel plate | 35 | 34.0 |
| 2 Circle | 5.1 | 1.00 | 0.080 | 0.41 | 0.61 | 0.43 parallel plate | 60 | 58.0 |
| 3 Rectangle | 6.0 | 1.45 | 0.092 | 0.80 | 1.12 | 0.79 cylindrical | 55 | 30.0 |
| 4 Rectangle | 6.3 | 0.70 | 0.096 | 0.43 | 0.99 | 0.79 Cylindrical | 64 | 49.2 |
| 5 Rectangle | 8.5 | 0.35 | 0.160 | 0.49 | 1.15 | 0.79 Cylindrical | 70 | 50.2 |
| 6 Rectangle | 17.1 | 0.72 | 0.210 | 2.60 | 6.00 | 0.77 cylindrical | 64 | 50.6 |

In calculating the values set forth in Table E, above, all the beta particles=A(Ci)·$3.7\times10^{10}$ (beta particles per second); the beta particles out of a surface=measured current/(geometrical factor·$1.6\times10^{-19}$); and the calculated efficiency of the source=

$$\frac{I(\text{nA})}{5.92\cdot A(\text{Ci})\cdot Geom.factor}.$$

As is shown in Table E, above, $\beta^-$-emitting sources with a beta flux efficiency that exceeded 50% were made.

D. Effect of Electron Irradiation on Polyimide Films

This study involved comparing electrical properties and electron radiation stability of several polymer films for determining their applicability for use in direct charge (DC) solid-state devices. Polyimide films were the subject to this test because they are known to have a good degree of radiation stability. Without being bound to a particular theory, it is believed that radiation stability of polyimides is due to a relatively high content of aromatic groups which are believed to provide protection against structural damage on exposure to electron irradiations due to their ability to dissipate absorbed energy to heat through manifold of vibration states. Despite being known as having good radiation stability, heretofore there was little information concerning the change of polyimide's properties, especially electrical ones, after electron irradiation.

Five types of films were studied: PMF-S-352—polyimide film coated with Teflon® layer on both sides; PMF-S-351—polyimide film coated with Teflon® layer on one side; PM-A-

TU—polyimide film without coating; PM-A—polyimide film without coating; and Apical—polyimide film without coating. Certain properties of the films were determined before they were irradiated: dielectric constant k and tangent of dielectric losses tgδ at 1 MHz frequency were measured using RLC-meter E7-12; dielectric constant k and tangent of dielectric losses tgδ at 1 kHz were measured using immitance meter E7-15; specific volume resistance $\rho_v$ and surface resistance $\rho_s$ of the films were measured with ohmmeter EK6-7 at 100V voltage and 1 kHz frequency during 1 min time; dielectric strength $E_{br}$ was measured at 50 Hz with a UPU-10 device. To arrive at a value for each of the foregoing parameters, five 100×100 mm samples of each film were tested and results were averaged. All measurements were done at 20±5° C. and relative humidity of 65±15%. The properties of tested films before irradiation are summarized in Table F, below.

TABLE F

| | Film | | | | |
|---|---|---|---|---|---|
| Parameter | PMF-S-352 | PMF-S-351 | PM-A-TU | PM-A | Apical |
| Thickness μm | 52-55 | 42-52 | 40-41 | 38 | 25 |
| $\rho_v$*$10^{16}$, Ohm*m | 2.0 | 1.4 | 1.6 | 1.7 | 2.1 |
| $\rho_s$*$10^{15}$, Ohm | 2.90 | 2.15 | 1.79 | 1.95 | 1.71 |
| k (1 MHz) | 1.96 | 2.11 | 2.22 | 2.19 | 1.90 |
| tgδ (1 MHz) | 0.0049 | 0.0037 | 0.0056 | 0.0037 | 0.0083 |
| tgδ (1 kHz) | 0.0015 | 0.0015 | 0.0015 | 0.0015 | 0.0015 |
| $E_{br}$, MV/m | 154 | 158 | 207 | 212 | 266 |

The data set forth in Table F indicates that the Apical film had the best specific resistance and dielectric strength. Further, the data shows that films with a Teflon® surface coating tend to have a better surface resistance but this parameter should be less critical in case of DC cells since in thin film capacitors major leakage is through the dielectric layer.

Figure 6:
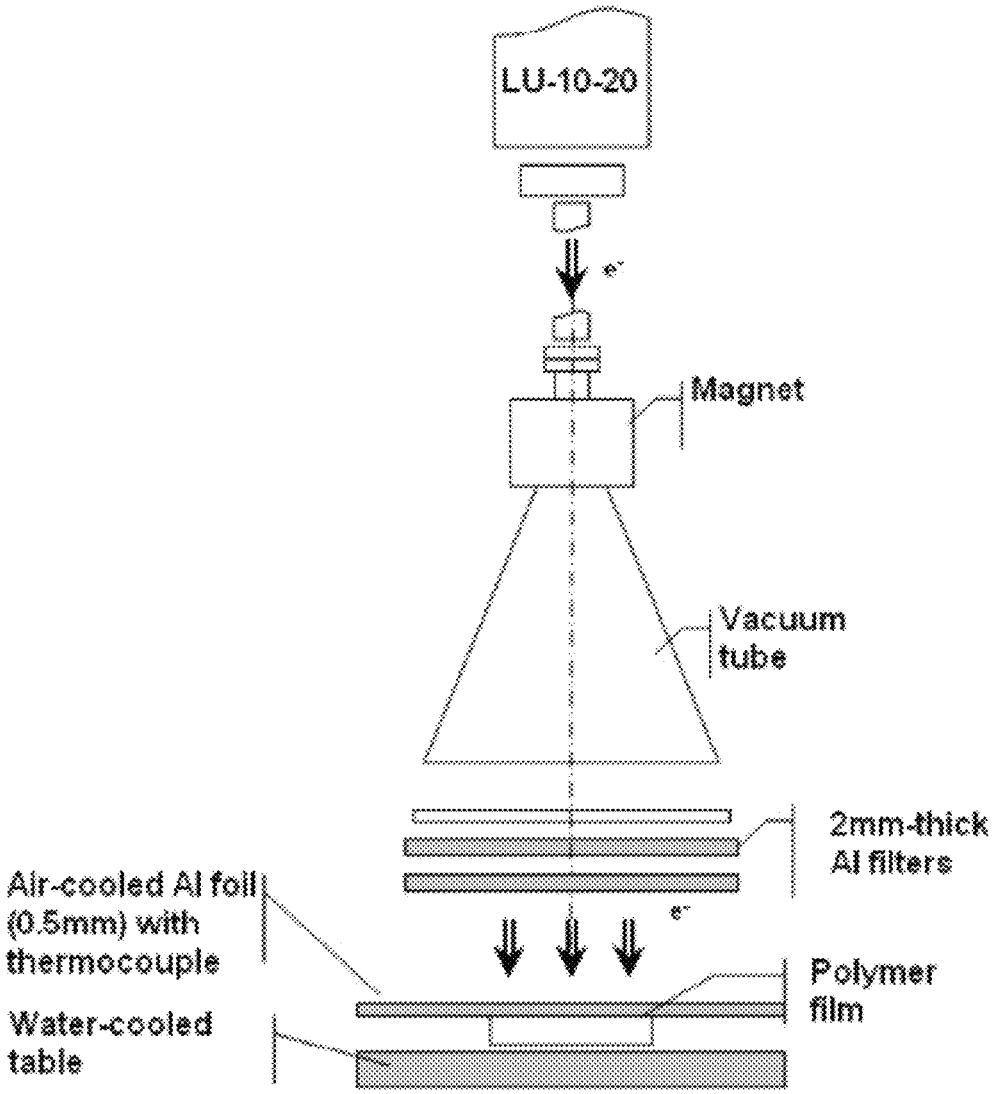
FIG. 6 is a schematic drawing of the film irradiation apparatus used in testing polymeric films for electron radiation stability.

The films were subjected to irradiation with 5 MeV electrons. Referring to FIG. 6, electron irradiation of polyimide films was done with the use of linear electron accelerator LU-10-20. It is mounted vertically and electron beam is directed downward. The accelerator generated 3.8□ sec micro-pulses with 1000 Hz repetition rate. The samples were placed onto the water-cooled aluminum table and covered atop with aluminum foil with thermocouple attached to it. The irradiated area was 10×20 $cm^2$. Dose was controlled by measurements of charge with the use of a digital integrator (the accuracy of the measurements was ±15%). The temperature of films during irradiation was approximately 50° C. After irradiation PMF-S-352 and PMF-S-351 films were warped and somewhat darkened (it is believed due to the destruction of Teflon®). The other films were also visually changed but to a lesser extent. Due to the warping there is a certain degree of dispersion in measured electrical properties after irradiation.

Figure 7:
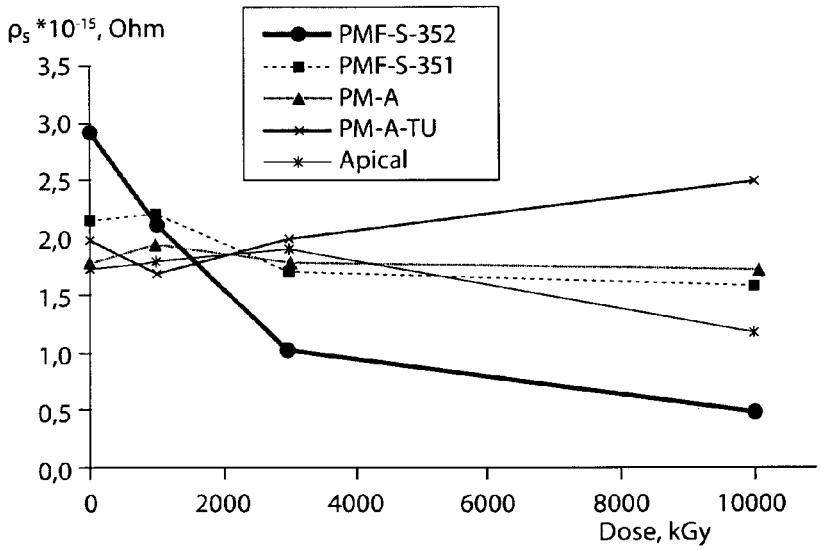
FIG. 7 is a graph showing the surface resistance of polymer films as a function of irradiation dose.

FIG. 7 depicts dependence of surface resistance of polyimide films on irradiation dose. One can see that for the PMF-S-352 film, which initially had the highest surface resistance, $\rho_s$ dropped 10-fold due to low radiation stability of the Teflon® coating on the surface. In case of the PM-A-TU film, $\rho_s$ increased after small drop at the 1,000 kGy dose probably due to a radiation induced curing of an incompletely cross-linked film. The other three types of films showed similar behavior—small increase of $\rho_s$ at doses 1,000-3,000 kGy followed by a radiation induced decrease of resistance.

Figure 8:
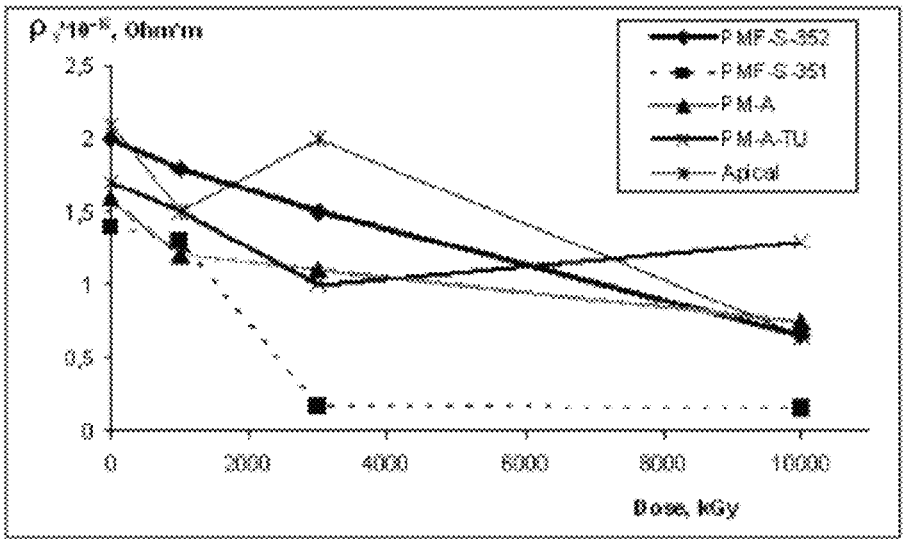
FIG. 8 is a graph showing the specific volume resistance of polymer films as a function of irradiation dose.

FIG. 8 shows the dependence of specific volume resistance on electron irradiation dose. There is a certain degree of dispersion of the data, nevertheless it can be seen that for all the samples the irradiation resulted in a decrease of $\rho_v$ with the PM-A-TU film decreasing the least. The most significant degradation occurred in the PMF-S-351 film, its resistance decreased almost 10-fold. Other three polymers showed much lower rate of resistance decrease and have a post-irradiation $\rho_v$ of about 7*$10^{15}$ Ohm*m.

Figure 9:
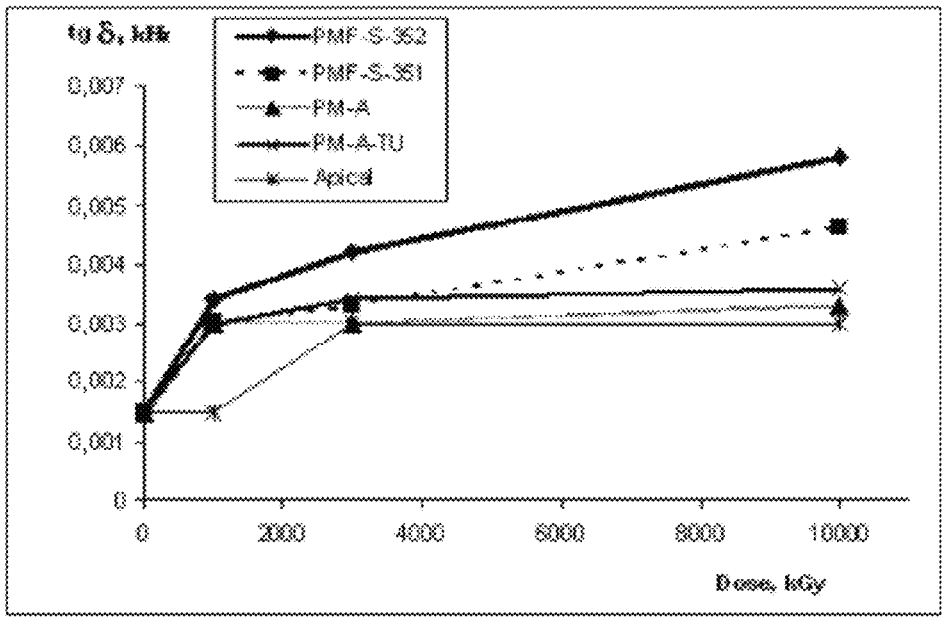
FIG. 9 is a graph showing the tangent of dielectric losses at 1 kHz of polymer films as a function of irradiation dose.

FIG. 9 depicts the tangent of dielectric losses (tgδ) measured at 1 kHz increased by a significant 2 to 4-fold after irradiation. Usually, such a large increase may be attributed to oxidation of the film surface and the formation of polar groups like carbonyls. The most rapid increase of tgδ occurred for the Teflon®-coated films PMF-S-352 and PMF-S-351 due to low radiation stability of Teflon®. The other three films showed approximately same properties after irradiation; among them the Apical had the lowest losses probably due to the high quality (i.e., low roughness) of surface, which resulted in a lower rate of oxidation.

Figure 10:
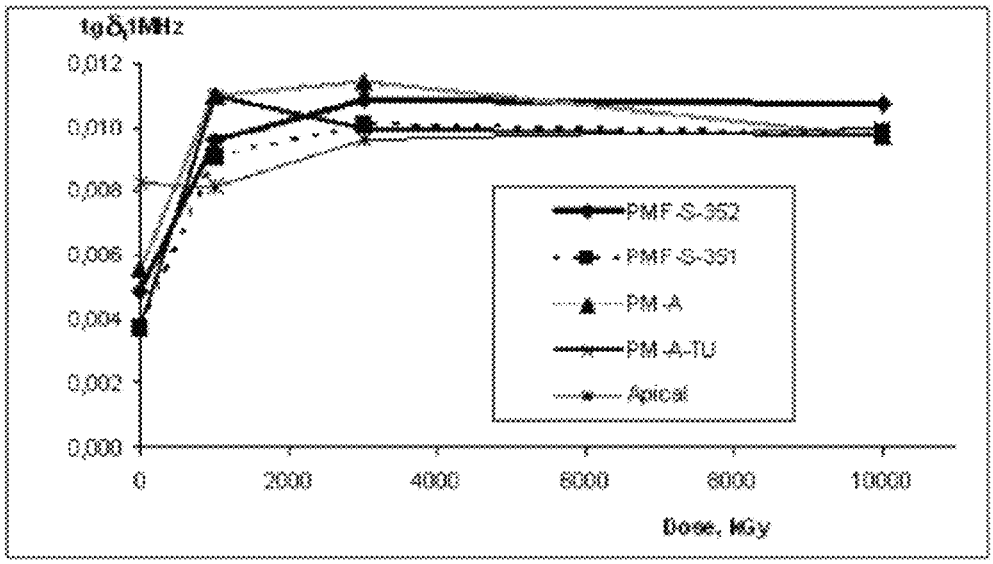
FIG. 10 is a graph showing the tangent of dielectric losses at 1 MHz of polymer films as a function of irradiation dose.

Referring to FIG. 10, at the 1 MHz frequency the values of tangent of dielectric losses are several times higher. Specifically, after electron irradiation the relative increase of tgδ in this case was smaller—a 1.2 to 2.6-fold compared to a 2 to 4-fold increase for the 1 kHz measurements. Again, the Teflon®-coated films had the highest losses after irradiation. Whereas the Apical film showed the smallest relative change of properties after irradiation, only about 20%.

Figure 11:
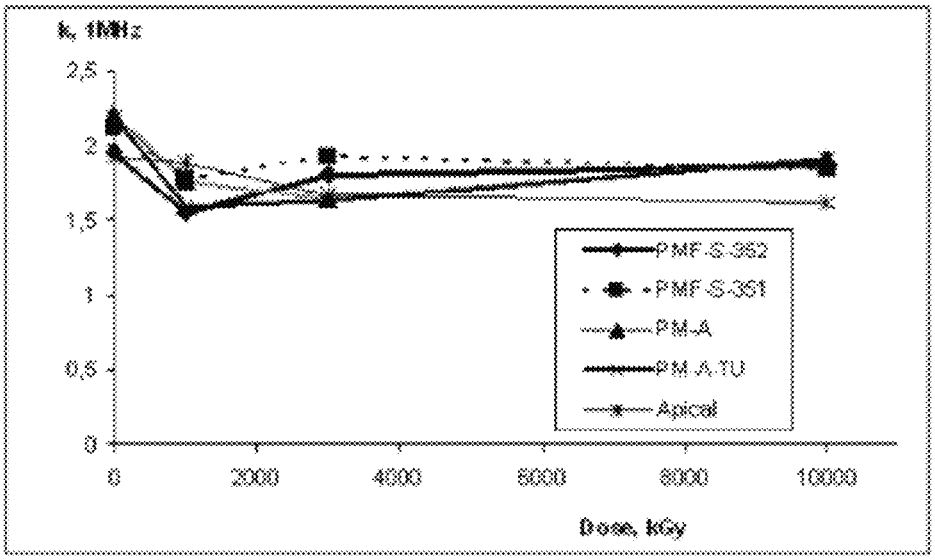
FIG. 11 is a graph showing the dielectric constant of polymer films as a function of irradiation dose.

Referring to FIG. 11, as for the dielectric constant, its value decreased some 13 to 15% after electron irradiation for the studied films, except for the sample PMF-S-352 for which the decrease was only 4%. This small change is probably due to KOROBLENIE of film and decreased actual area of capacitance measurements and thus does not reflect the real situation. Also, the dielectric constants decreased at small doses and then increased with the larger doses, which suggest two phenomena occurred and the depiction is the result of a superposition of the two phenomena. First, it is believed that the irradiation caused a decrease of the polymer's k value in the bulk of the film that may be due to cross-linking decreasing segmental mobility. Second, it is believed that the oxidation of surface and formation of polar oxygen-containing groups (as confirmed by significant increase of tgδ) caused an increase in the dielectric constant of the surface layers of polymer.

Figure 12:
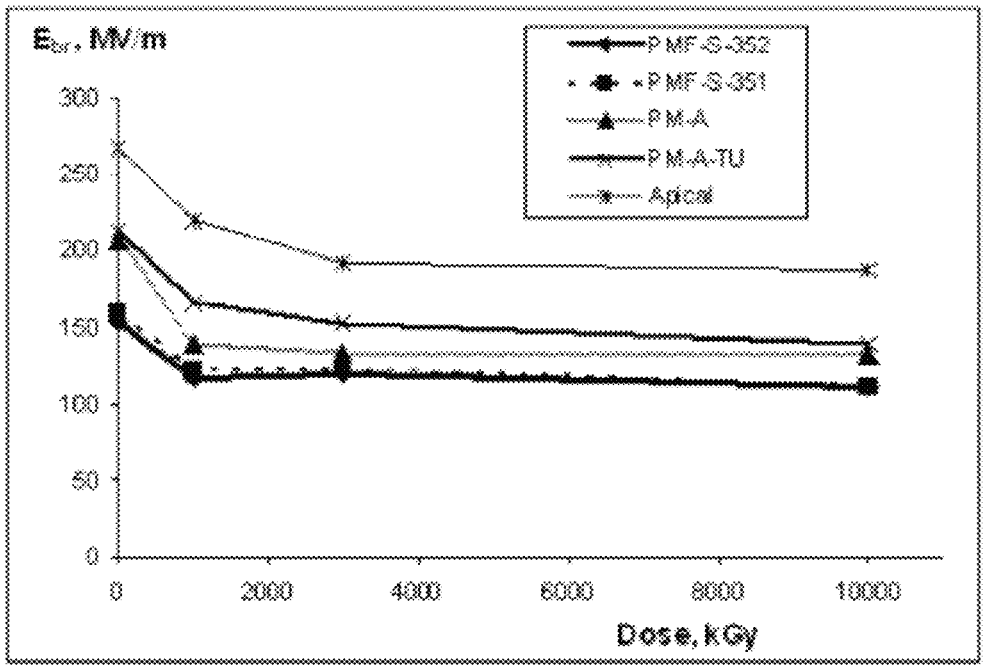
FIG. 12 is a graph showing the dielectric strength of polymer films as a function of irradiation dose.

Referring to FIG. 12, which depicts the change of dielectric strength as a result of irradiation. It shows that the irradiation decreased $E_{br}$ for all the tested films. A comparison of FIGS. 9, 10, and 12 shows that there is clear inverse relationship between tgδ and $E_{br}$, therefore decrease of dielectric strength is also caused by oxidation of films. The changes of the $E_{br}$ are very similar for the tested films, and all of the samples lost approximately one third of the initial value of the $E_{br}$. It should be noted, however, that the absolute value of dielectric strength of Apical film is much higher compared to that of the other samples at all dose levels. Moreover, after an initial decrease of $E_{br}$ for 1,000-3,000 kGy doses its value stabilized and almost did not changed when dose was increased to 10,000 kGy.

Based on the test results, it may be concluded that the Teflon®-coated films had good initial electrical properties but were not suitable for applications requiring stability under electron irradiation. Among the tested samples, it is believed that the Apical film is the most suitable for use in direct charge applications because it is important for dielectric in such devices to have a high dielectric strength and a high specific volume resistance after irradiation.

Figure 13:
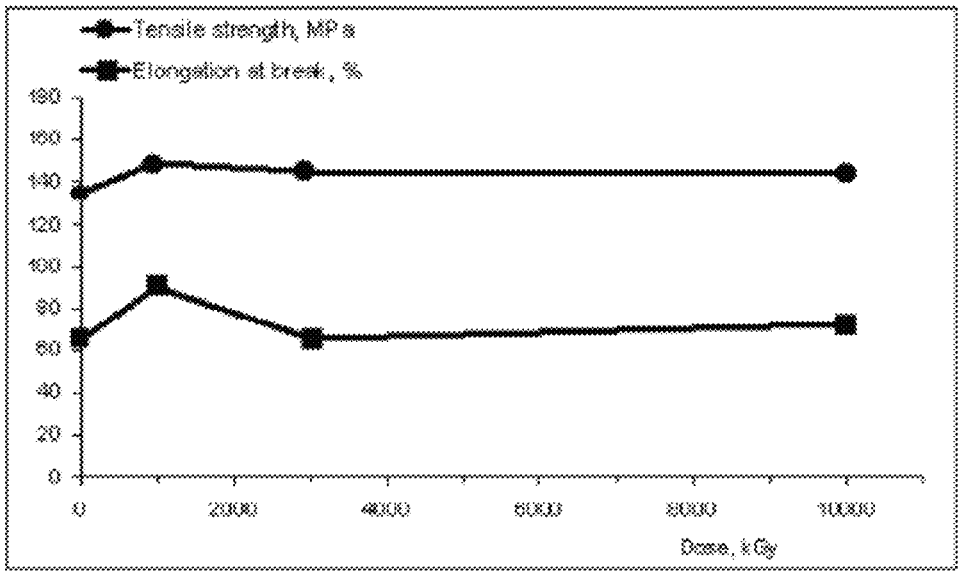
FIG. 13 is graph showing the dependence of certain mechanical properties of a polyimide film as a function of irradiation dose.
Figure 14:
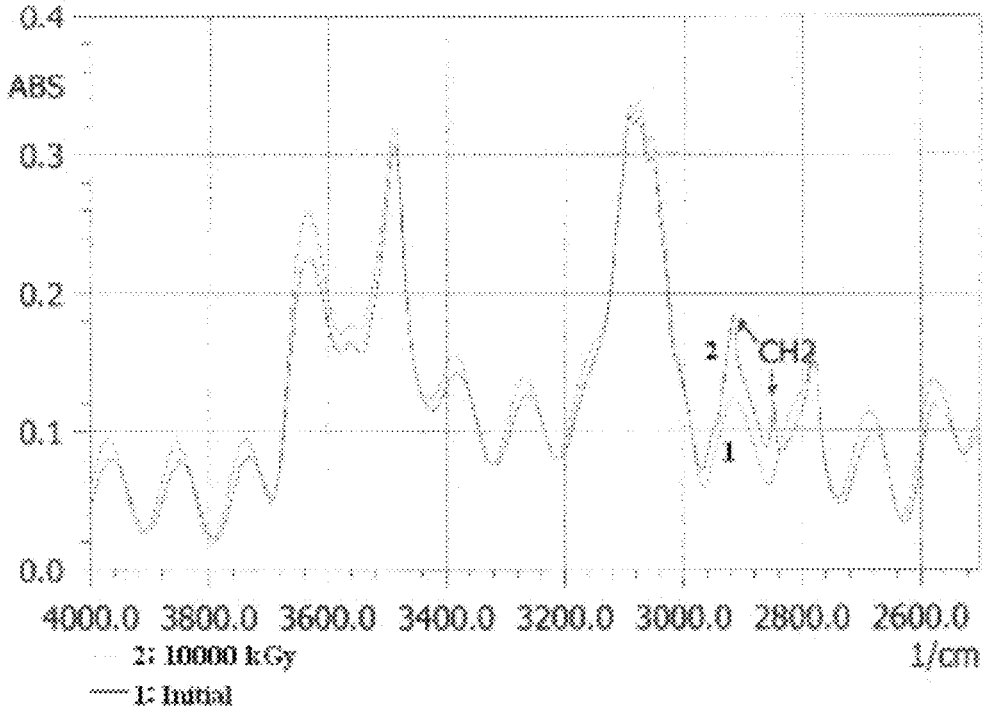
FIG. 14 is a graph comparing the IR spectra transmittance of a pre- and post-electron irradiated polyimide film.
Figure 15:
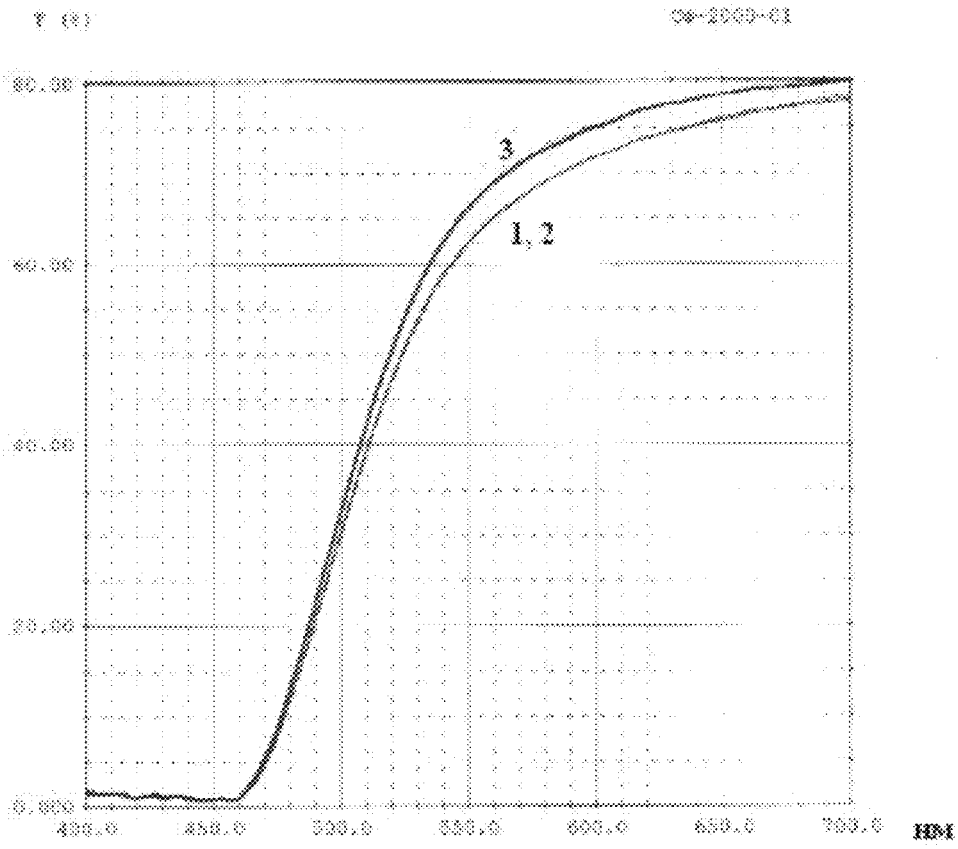
FIG. 15 is graph comparing the UV-VIS spectra transmittance of Apical films irradiated at 1,000 kGy (1), 3,000 kGy (2), and 10,000 kGy (3).

In addition to good stability of electrical properties, Apical film has extremely stable mechanical properties as shown in FIG. 13 and optical properties shown in FIGS. 14 and 15. As set forth in FIG. 13, electron irradiation with a dose of 1,000 kGy provided 10% increase of tensile strength which then stabilized and at higher doses have constant value of 145 MPa. As set forth in FIGS. 14 and 15, the above-described radiation-induced changes to the Apical film had little impact on the optical properties of the film. For example, IR spectra of FIG. 14 shows that the measurements are within their accuracy limit, except for the bands at 2850-2950 $cm^{-1}$. It is believed that the difference at these bands is most likely due to the presence of $CH_2$-groups due to surface contamination of films. Referring to FIG. 15, there are no changes in the UV-VIS transmittance for the doses 1,000 and 3,000 kGy but at 10,000 kGy there is small increase of transmittance in visible range of spectra.

In conclusion, radiation hardness to electron irradiation of several types of Teflon®-coated and bare polyimide films was studied. It was discovered that Apical film had a very good stability of electrical, mechanical, and optical properties and thus may be particularly desirable for use as a dielectric material in direct charge devices.

E. Efficiency of Radioisotope Charge Capacitor Designs

Utilizing the apparatus described in Example A, above, and depicted in FIG. 23, efficiency tests were performed for tritium and promethium-147 charged capacitors. The promethium-147 charged capacitors were tested in the same manner as the tritium charged capacitor described in Example C, above. The results are set forth in Table H, below.

TABLE H

| | | | Thermal | Electrical Output | | Overall |
|---|---|---|---|---|---|---|
| Isotope | Capacitor Detail | Activity Ci | power mW | Power mW | Voltage kV | Capacitor Efficiency |
| H-3 | Example C capacitor | 38 | 1.28 | 0.16 | 5.3 | 12.5% |
| Pm-147 | Example D, source 4 capacitor | 0.43 | 0.16 | 0.016 | 27 | 10% |
| Pm-147 | Example 5, source 5 capacitor | 2.6 | 0.95 | 0.11 | 30.5 | 11.5% |

As various modifications could be made in the constructions and methods herein described and illustrated without departing from the scope of the invention, it is intended that all matter contained in the foregoing description shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An encapsulated $\beta^-$ particle emitter, the emitter comprising:

a. a sol-gel derived core that comprises a $\beta^-$-emitting radioisotope; and b. an encapsulant enclosing the core through which at least some of the $\beta^-$ emissions from the $\beta^-$-emitting radioisotope pass, wherein the encapsulant comprises a substrate and a cover and at least a portion of the encapsulant is electrically conductive.

2. The encapsulated $\beta^-$ particle emitter of claim 1, wherein substantially all of the substrate and cover are electrically conductive.

3. The encapsulated $\beta^-$ particle emitter of claim 1, wherein the cover is an electrically conductive sheet and the substrate is an electrically conductive sheet that is thicker than the cover and is able to support the core and cover without substantial deformation.

4. The encapsulated $\beta^-$ particle emitter of claim 3, wherein the $\beta^-$-emitting radioisotope is $^{147}Pm$.

5. The encapsulated $\beta^-$ particle emitter of claim 4, wherein the core has a mass thickness no greater than about 2 $mg/cm^2$.

6. The encapsulated $\beta^-$ particle emitter of claim 5, wherein the substrate has a mass thickness that is no greater than about 2.5 $mg/cm^2$ and the cover has a mass thickness that is no greater than about 0.6 $mg/cm^2$.

7. The encapsulated $\beta^-$ particle emitter of claim 6 having a $\beta^-$ particle emission efficiency of at least about 50%, wherein the substrate and the cover consist essentially of aluminum and the substrate has a thickness that is no more than about 8 μm and the cover has a thickness that is no more than about 2 μm.

8. The encapsulated $\beta^-$ particle emitter of claim 1, wherein the $\beta^-$-emitting radioisotope is at a concentration that is substantially uniformly throughout the sol-gel derived core.

9. The encapsulated $\beta^-$ particle emitter of claim 1, wherein the $\beta^-$-emitting radioisotope is selected from the group consisting of $^{3}H$, $^{10}Be$, $^{14}C$, $^{36}Cl$, $^{59}Fe$, $^{60}Fe$, $^{60}Co$, $^{63}Ni$, $^{79}Se$, $^{87}Rb$, $^{90}Sr$, $^{93}Zr$, $^{94}Nb$, $^{95}Tc$, $^{99}Mo$, $^{99}Tc$, $^{106}Ru$, $^{107}Pd$, $^{110}Ag$, $^{111}Ag$, $^{121}Sn$, $^{124}Sb$, $^{125}Sb$, $^{129}I$, $^{134}Cs$, $^{135}Cs$, $^{137}Cs$, $^{144}Ce$, $^{146}Pm$, $^{147}Pm$, $^{151}Sm$, $^{150}Eu$, $^{152}Eu$, $^{154}Eu$, $^{160}Tb$, $^{166}Ho$, $^{170}Tm$, $^{171}Tm$, $^{182}Ta$, $^{185}W$, $^{188}W$, $^{194}Os$, $^{204}Tl$, $^{227}Ac$, $^{228}Ra$, $^{241}Pu$, and combinations thereof.

10. The encapsulated $\beta^-$ particle emitter of claim 1, wherein the $\beta^-$-emitting radioisotope is selected from the group consisting of $^{3}H$, $^{63}Ni$, $^{90}Sr$, and $^{147}Pm$.

11. The encapsulated $\beta^-$ particle emitter of claim 1, wherein the encapsulant has a density that is no greater than about 9 $g/cm^3$.

12. The encapsulated $\beta^-$ particle emitter of claim 11, wherein the encapsulant comprises one or more elements selected from the group consisting of Be, Al, and Ti.

13. The encapsulated $\beta^-$ particle emitter of claim 11, wherein the encapsulant consists essentially of aluminum or a low-density aluminum-based alloy.

14. The encapsulated $\beta^-$ particle emitter of claim 1, wherein the sol-gel derived core, in addition to the $\beta^-$-emitting radioisotope, comprises oxides of elements selected from the group consisting of silicon, boron, zirconium, titanium, aluminum, and combinations thereof.

15. The encapsulated $\beta^-$ particle emitter of claim 1, wherein the sol-gel derived core, in addition to the $\beta^-$-emitting radioisotope, comprises oxides of silicon.

16. The encapsulated $\beta^-$ particle emitter of claim 15, wherein the sol-gel derived core further comprises oxides of titanium in amount of up to 40 percent by weight of the sol-gel derived core.

17. A method for making an encapsulated $\beta^-$ particle emitter, the method comprising:

a. depositing a $\beta^-$-emitting radioisotope-containing sol-gel on a surface of a substrate;

b. curing the deposited $\beta^-$-emitting radioisotope-containing sol-gel to form a solid radioactive oxide coating comprising the $\beta^-$-emitting radioisotope and an oxide; and c. placing a cover, at least a portion of which is an electrically conductive sheet, on the deposited $\beta^-$-emitting radioisotope-containing sol-gel so that cover in combination with the substrate encapsulate the cured deposited $\beta^-$-emitting radioisotope-containing sol-gel.

18. The method of claim 17, wherein the cover is placed on the deposited $\beta^-$-emitting radioisotope-containing sol-gel before the curing is complete.

19. The method of claim 18 further comprising heat treating the encapsulated $\beta^-$ particle emitter in order to condense the cured $\beta^-$-emitting radioisotope-containing sol-gel.

20. The method of claim 19, wherein the heat treating comprises heating the encapsulated $\beta^-$ particle emitter to a temperature within the range of about 60° C. to about 80° C. for a duration of about 12 hours.

21. The method of claim 17, wherein the surface of the substrate is contacted with a coupling agent before the $\beta^-$-emitting radioisotope-containing sol-gel is deposited on the surface of the substrate, wherein the $\beta^-$-emitting radioisotope-containing sol-gel further comprises a coupling agent, or a combination thereof in order to enhance the adhesion between the cured $\beta^-$-emitting radioisotope-containing sol-gel and the surface of the substrate.

22. The method of claim 21, wherein the coupling agent is an alkoxy silane.

23. The method of claim 22, wherein the coupling agent is glycidoxypropyltrimethoxysilane.

24. The method of claim 17, wherein the cover is an electrically conductive sheet that has a mass thickness that is no greater than about 0.6 mg/cm$^2$ and the substrate is an electrically conductive sheet that has mass thickness that is no greater than about 2.5 mg/cm$^2$ and is able to support the core and cover without substantial deformation.

25. The method of claim 24, wherein the substrate and cover each consist essentially of aluminum, a low-density aluminum-based alloy, titanium, a low-density titanium-based alloy, or combinations thereof.

26. The method of claim 17, wherein the $\beta^-$-emitting radioisotope is at a concentration that is substantially uniformly throughout the $\beta^-$-emitting radioisotope-containing sol-gel.

27. The method of claim 17, wherein the $\beta^-$-emitting radioisotope is selected from the group consisting of $^{10}$Be, $^{59}$Fe, $^{60}$Fe, $^{60}$Co, $^{63}$Ni, $^{79}$Se, $^{87}$Rb, $^{90}$Sr, $^{93}$Zr, $^{94}$Nb, $^{98}$Tc, $^{99}$Mo, $^{99}$Tc, $^{106}$Ru, $^{107}$Pd, $^{110}$Ag, $^{111}$Ag, $^{121}$Sn, $^{124}$Sb, $^{125}$Sb, $^{134}$Cs, $^{135}$Cs, $^{137}$Cs, $^{144}$Ce, $^{146}$Pm, $^{147}$Pm, $^{151}$Sm, $^{150}$Eu, $^{152}$Eu, $^{154}$Eu, $^{160}$Tb, $^{166}$Ho, $^{170}$Tm, $^{171}$Tm, $^{182}$Ta, $^{185}$W, $^{188}$W, $^{194}$Os, $^{204}$Tl, $^{227}$Ac, $^{228}$Ra, $^{241}$Pu, and combinations thereof.

28. The method of claim 17, wherein the $\beta^-$-emitting radioisotope is selected from the group consisting of $^{63}$Ni, $^{90}$Sr, and $^{147}$Pm.

29. The method of claim 17, wherein the $\beta^-$-emitting radioisotope is $^{147}$Pm.

30. The method of claim 17, wherein the cured $\beta^-$-emitting radioisotope-containing sol-gel has a mass thickness no greater than about 2 mg/cm$^2$.

31. The method of claim 17, wherein the $\beta^-$-emitting radioisotope-containing sol-gel, in addition to the $\beta^-$-emitting radioisotope, comprises alkoxides of oxides of elements selected from the group consisting of silicon, boron, zirconium, titanium, aluminum, and combinations thereof.

32. The method of claim 17, wherein the $\beta^-$-emitting radioisotope-containing sol-gel, in addition to the $\beta^-$-emitting radioisotope, comprises alkoxides of silicon.

33. The method of claim 32, wherein the $\beta^-$-emitting radioisotope-containing sol-gel further comprises alkoxides of titanium in amount of up to 40 percent by weight of the $\beta^-$-emitting radioisotope-containing sol-gel.

34. A directly charged beta (negatron) nuclear decay capacitor comprising:

a. an encapsulated $\beta^-$ particle emitter that comprises:
   i. a sol-gel derived core that comprises a $\beta^-$-emitting radioisotope; and
   ii. an encapsulant enclosing the core through which at least some of the $\beta^-$ emissions from the $\beta^-$-emitting radioisotope pass, wherein the encapsulant comprises a substrate and a cover and at least a portion of the encapsulant is electrically conductive;

b. an electrically conductive collector for collecting $\beta^-$ particles from the encapsulated $\beta^-$ particle emitter; and c. a dielectric between the encapsulated $\beta^-$ particle emitter and the electrically conductive collector.

35. The directly charged beta (negatron) nuclear decay capacitor of claim 34, wherein the dielectric has a dielectric strength of at least about 200V/micron and a density that is no greater than about 2.5 g/cm$^3$.

36. The directly charge beta (negatron) nuclear decay capacitor of claim 35, wherein the dielectric is an electrical insulating material or a vacuum.

37. The directly charge beta (negatron) nuclear decay capacitor of claim 35, wherein the dielectric comprises polyimides.

38. The directly charged beta (negatron) nuclear decay capacitor of claim 35, wherein at least the portion of the collector for which $\beta^-$ particles from the emitter will be incident is a metal and wherein: (a) the dielectric suppresses the emission of secondary electrons from said metallic portion of the collector, (b) the directly charged beta (negatron) nuclear decay capacitor further comprises a secondary suppression coating on said metallic portion of the collector, or (c) both (a) and (b).

39. The directly charged beta (negatron) nuclear decay capacitor of claim 38, wherein dielectric comprises one or more radiation-resistant polymers and the secondary suppression coating comprises one or more radiation-resistant polymers, graphite, or a combination thereof.

40. The directly charged beta (negatron) nuclear decay capacitor of claim 39, wherein the one or more radiation-resistant polymers are selected from the group consisting of polyimides, polyetherimdes, polyamideimides, polyphenylene sulfides, polyetheretherketones, polystyrenes, polyarylates, polyarylamides, polyethersulfides, polysulfones, polyamides, polyphenyloxides, and combinations thereof.

41. The directly charged beta (negatron) nuclear decay capacitor of claim 34 further comprising a multiplicity of encapsulated $\beta^-$ particle emitters, a multiplicity of electrically conductive collectors, or a multiplicity of encapsulated $\beta^-$ particle emitters and a multiplicity of electrically conductive collectors.

42. The directly charged beta (negatron) nuclear decay capacitor of claim 34, the cover is an electrically conductive sheet and the substrate is an electrically conductive sheet that is thicker than the cover and is able to support the core and the cover without substantial deformation.

43. The directly charged beta (negatron) nuclear decay capacitor of claim 34, wherein the $\beta^-$-emitting radioisotope is selected from the group consisting of $^{63}$Ni, $^{90}$Sr, and $^{147}$Pm.

44. The directly charged beta (negatron) nuclear decay capacitor of claim 34, wherein the encapsulated $\beta^-$ particle emitter has a $\beta^-$ particle emission efficiency of at least about 50%, the substrate and the cover consist essentially of aluminum, and the substrate has a thickness that is no more than about 8 μm and the cover has a thickness that is no more than about 2 μm.

45. The directly charged beta (negatron) nuclear decay capacitor of claim 34, wherein the sol-gel derived core, in addition to the $\beta^-$-emitting radioisotope, comprises oxides of elements selected from the group consisting of silicon, boron, zirconium, titanium, aluminum, and combinations thereof.

46. A method of performing work, the method comprising delivering the electrical energy of a directly charged beta (negatron) nuclear decay capacitor through a circuit, wherein the directly charged beta (negatron) nuclear decay capacitor comprises:

a. an encapsulated $\beta^-$ particle emitter that comprises:
   i. a sol-gel derived core that comprises a $\beta^-$-emitting radioisotope; and
   ii. an encapsulant enclosing the core through which at least some of the $\beta^-$ emissions from the $\beta^-$-emitting radioisotope pass, wherein the encapsulant comprises a substrate and a cover and at least a portion of the encapsulant is electrically conductive;

b. an electrically conductive collector for collecting $\beta^-$ particles from the encapsulated $\beta^-$ particle emitter; and c. a dielectric between the encapsulated $\beta^-$ particle emitter and the electrically conductive collector.

47. A directly charged beta (negatron) nuclear decay capacitor comprising a $\beta^-$ particle emitter, an electrically conductive collector for collecting $\beta^-$ particles from the $\beta^-$ particle emitter, and a dielectric between the encapsulated $\beta^-$ particle emitter and the electrically conductive collector, wherein at least the portion of the collector for which $\beta^-$ particles from the emitter will be incident is a metal and is contact with a volume of one or more radiation-resistant polymers that suppress the emission of secondary electrons from said metallic portion of the collector.

48. The directly charged beta (negatron) nuclear decay capacitor of claim 47, wherein the one or more radiation-resistant polymers are selected from the group consisting of polyimides, polyetherimdes, polyamideimides, polyphenylene sulfides, polyetheretherketones, polystyrenes, polyarylates, polyarylamides, polyethersulfides, polysulfones, polyamides, polyphenyloxides, and combinations thereof.

49. The directly charge beta (negatron) nuclear decay capacitor of claim 48, wherein the one or more radiation-resistant polymers in the form of a film.

* * * * *